US010730309B2

(12) United States Patent
Miyao et al.

(10) Patent No.: US 10,730,309 B2
(45) Date of Patent: Aug. 4, 2020

(54) LIQUID CARTRIDGE INCLUDING SUBSTRATE HAVING SLOPED SURFACE

(71) Applicant: BROTHER KOGYO KABUSHIKI KAISHA, Nagoya-shi, Aichi-ken (JP)

(72) Inventors: Takahiro Miyao, Nagoya (JP); Akihito Ono, Nagoya (JP); Kosuke Nukui, Nagoya (JP); Fumio Nakazawa, Okazaki (JP); Hiroaki Takahashi, Nagoya (JP); Tetsuro Kobayashi, Chiryu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/118,666

(22) Filed: Aug. 31, 2018

(65) Prior Publication Data

US 2019/0299628 A1 Oct. 3, 2019

(30) Foreign Application Priority Data

Mar. 29, 2018 (JP) ..... 2018-064182

(51) Int. Cl.
*B41J 2/175* (2006.01)

(52) U.S. Cl.
CPC ..... *B41J 2/17526* (2013.01); *B41J 2/1753* (2013.01); *B41J 2/17513* (2013.01);
(Continued)

(58) Field of Classification Search
CPC ..... B41J 2/17526; B41J 2/1753
See application file for complete search history.

(56) References Cited

U.S. PATENT DOCUMENTS 6,547,363 B1 * 4/2003 Shinada ..... B41J 2/17503 347/19
6,648,445 B2 * 11/2003 Ishizawa ..... B41J 2/17503 347/19

(Continued)

FOREIGN PATENT DOCUMENTS

CN 204605193 U 9/2015
DE 20 2009 003 839 U1 6/2009

(Continued)

OTHER PUBLICATIONS

Extended European Search Report issued in related European Patent Application No. 18192092.7, dated Jan. 25, 2019.

*Primary Examiner* — Shelby L Fidler
(74) *Attorney, Agent, or Firm* — Merchant & Gould P.C.

(57) ABSTRACT

A liquid cartridge is insertable into an attachment portion of a printing device in an insertion direction and attached thereto in an upright posture. The liquid cartridge includes: a housing defining a liquid chamber; a substrate; a contact; and a memory electrically connected to the contact. The substrate in the upright posture defines a sloped surface facing upward and sloping relative to a first imaginary plane extending in the insertion direction and a widthwise direction orthogonal to the insertion direction and a gravitational direction. The contact is formed on the sloped surface. An acute angle formed between the sloped surface and the first imaginary plane is greater than an acute angle formed between the first imaginary plane and a second imaginary plane passing through: a contact point between the contact and a contact of the device; and a lower end of a wall constituting a holder of the attachment portion.

11 Claims, 21 Drawing Sheets

(52) U.S. Cl.
CPC ..... *B41J 2/17523* (2013.01); *B41J 2/17546* (2013.01); *B41J 2/17553* (2013.01)

(56) References Cited

U.S. PATENT DOCUMENTS

| | | | | |
|---|---|---|---|---|
| 8,678,573 | B2 | 3/2014 | Nakamura et al. | |
| 2006/0250446 | A1* | 11/2006 | Wanibe | B41J 2/1753 347/50 |
| 2016/0288513 | A1* | 10/2016 | Wang | H02H 7/20 |
| 2017/0021634 | A1* | 1/2017 | Tsukahara | B41J 2/17513 |

FOREIGN PATENT DOCUMENTS

| | | | |
|---|---|---|---|
| EP | 3 300 901 | A1 | 4/2018 |
| JP | 2013-49164 | A | 3/2013 |
| JP | 2017-56686 | A | 3/2017 |

* cited by examiner

LIQUID CARTRIDGE INCLUDING SUBSTRATE HAVING SLOPED SURFACE

CROSS REFERENCE TO RELATED APPLICATION

This application claims priority from Japanese Patent Application No. 2018-064182 filed Mar. 29, 2018. The entire content of the priority application is incorporated herein by reference.

TECHNICAL FIELD

The present disclosure relates to a liquid cartridge storing liquid therein, and a system including the liquid cartridge, and an attachment section to which the liquid cartridge is attachable.

BACKGROUND

One conventional system known in the art includes an ink cartridge, and an inkjet recording apparatus. The inkjet recording apparatus includes an attachment section, and the ink cartridge can be mounted into and extracted from the attachment section. The attachment section of the inkjet recording apparatus includes contacts.

A circuit board may be provided at an ink cartridge (see Japanese Patent Application Publication No. 2013-049164, for example). Memory is mounted on the circuit board for storing such information as a color and material composition of ink stored in the cartridge, a residual quantity of ink, and the like. Electrodes are also formed on the circuit board. Electrical connections are formed between the electrodes on the ink cartridge and the contacts in the attachment section when the ink cartridge is mounted in the attachment section, enabling the inkjet recording apparatus to read information stored in the memory.

Further, in order to form electrodes and the like and to mount memory and the like on a circuit board, the circuit board must be at least a certain size.

SUMMARY

As the functionality of circuit boards continues to improve, the number of components mounted on the circuit boards has increased. For example, components other than memory (batteries, for example) are now being mounted on these circuit boards. Such additions increase the size of the circuit board. In the meantime, walls have been considered as a measure for preventing a user from touching the contacts in the attachment section. The walls are provided in the attachment section on the front and rear sides of the contacts with respect to an insertion direction of the ink cartridge into the attachment section so as to extend downward to a position lower than the contacts. However, the provision of such walls restricts a front-rear dimension of the circuit board.

In view of the foregoing, it is an object of the present disclosure to provide a liquid cartridge including a circuit board (substrate) on which formed are electrodes that can be electrically connected to contacts in an attachment section without requiring the circuit board (substrate) to have smaller dimensions in a case where walls for protecting the contacts are arranged around the periphery of the contacts. It is another object of the present disclosure to provide a system equipped with this liquid cartridge.

In order to attain the above and other objects, according to one aspect, the present disclosure provides a liquid cartridge configured to be inserted into an attachment portion of a printing device in an insertion direction crossing a gravitational direction and attached to the attachment portion in an upright posture. The attachment portion includes: a holder defining an internal space for accommodating the liquid cartridge in the upright posture; a contact provided at the holder; a first wall provided at the holder and having a first lower end positioned forward in the insertion direction and lower in the gravitational direction relative to the contact of the device; and a second wall provided at the holder and having a second lower end positioned rearward in the insertion direction and lower in the gravitational direction relative to the contact of the device. The contact of the device is positioned between the first wall and the second wall in the insertion direction. The liquid cartridge includes a housing, a substrate, a contact and a memory. The housing includes: a liquid chamber storing liquid therein; and a liquid passage extending frontward in the insertion direction from the liquid chamber. The substrate has a length in the insertion direction greater than a distance between the first wall and the second wall in the insertion direction. The substrate in the upright posture defines a sloped surface facing upward and sloping relative to a first imaginary plane extending in the insertion direction and a widthwise direction orthogonal to the insertion direction and the gravitational direction. The contact of the cartridge is formed on the sloped surface of the substrate and is electrically connectable to the contact of the device at a contact point in the upright posture. The memory is mounted on the substrate and is electrically connected to the contact of the cartridge. The sloped surface forms a first acute angle relative to the first imaginary plane. A second imaginary plane forms a second acute angle relative to the first imaginary plane. A third imaginary plane forms a third acute angle relative to the first imaginary plane. The second imaginary plane passes through the contact point and the second lower end of the second wall and extends in the widthwise direction. The third imaginary plane passes through the contact point and the first lower end of the first wall and extends in the widthwise direction. The first acute angle is greater than at least one of the second acute angle and the third acute angle.

According to still another aspect, the present disclosure also provides a liquid cartridge configured to be inserted into an attachment portion of a printing device in an insertion direction crossing a gravitational direction and attached to the attachment portion in an upright posture. The liquid cartridge includes a housing, a substrate, a contact, a memory and an electronic component. The housing includes: a liquid chamber storing liquid therein; and a liquid passage extending frontward in the insertion direction from the liquid chamber. The substrate extends in the insertion direction. The substrate has an upper surface facing upward and sloping relative to the insertion direction in the upright posture. The contact of the cartridge is formed on the upper surface of the substrate. The memory is mounted on the substrate and is electrically connected to the contact of the cartridge. The electronic component is mounted on the substrate and is electrically connected to the memory for supplying power to the memory. The electronic component is positioned lower than the contact of the cartridge in the upright posture.

According to still another aspect, the present disclosure provides a liquid cartridge configured to be inserted into an attachment portion of a printing device in an insertion direction crossing a gravitational direction and attached to the attachment portion in an upright posture. The liquid cartridge includes a housing, a substrate, a contact, a memory and an electronic component. The housing includes: a liquid chamber storing liquid therein; and a liquid passage extending forward in the insertion direction from the liquid chamber. The substrate extends upward in the upright posture. The substrate has a thickness in the insertion direction and a length in the gravitational direction in the upright posture, the length being greater than the thickness. The contact is formed on an upper end face of the substrate and is electrically connectable to a contact of the printing device in the upright posture. The memory is mounted on the substrate and electrically connected to the contact of the cartridge. The electronic component is mounted on the substrate and electrically connected to the memory for supplying power to the memory.

DETAILED DESCRIPTION

Hereinafter, an embodiment of the disclosure will be described in detail while referring to accompanying drawings. It would be apparent to those skilled in the art that the embodiment described below is merely an example of the present disclosure and modifications and variations may be made therein without departing from the scope of the disclosure.

<Overview of Printer 10>

Figure 1:
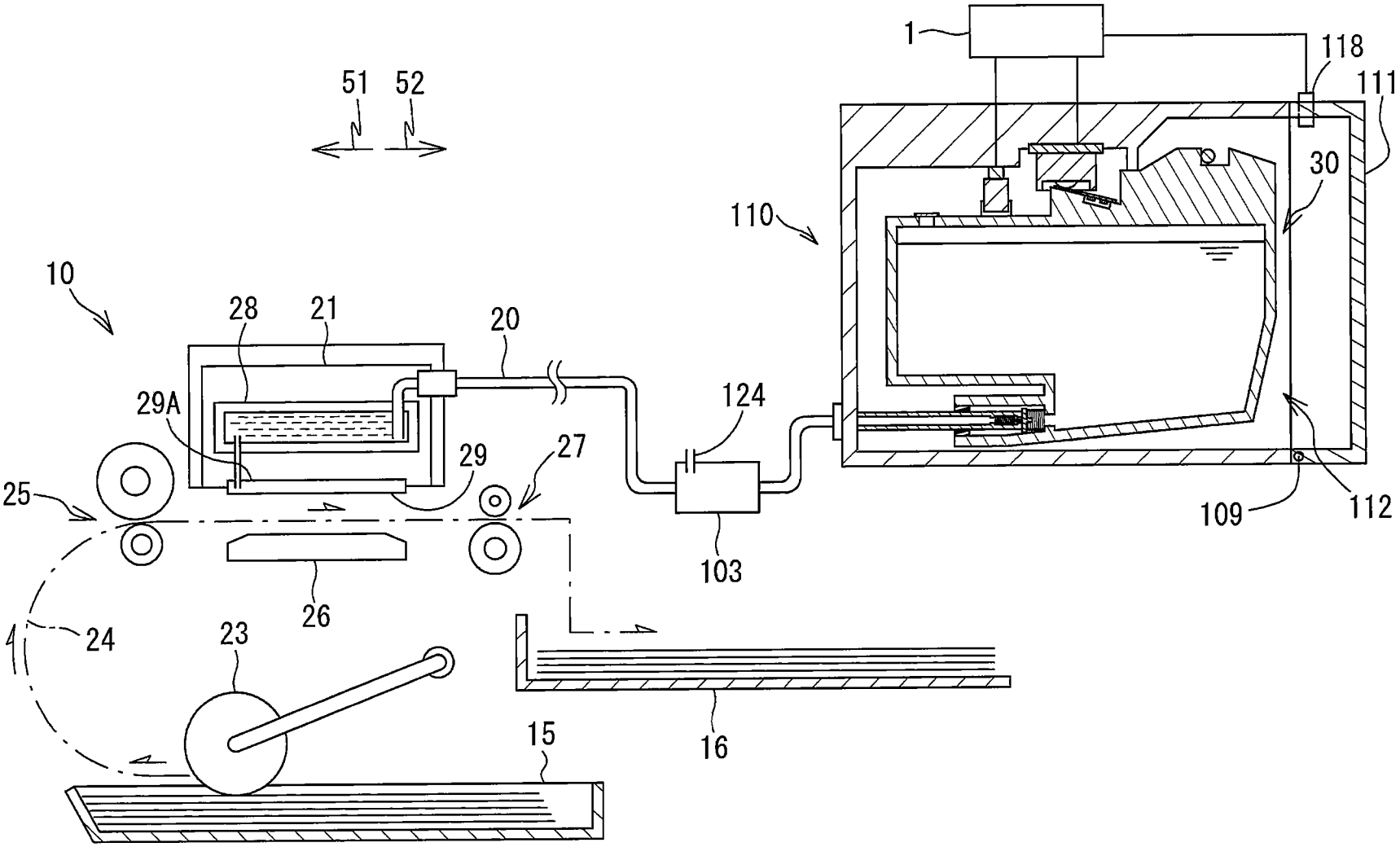
FIG. 1 is a vertical cross-sectional diagram schematically illustrating an internal structure of a printer according to an embodiment of the present disclosure.

As shown in FIG. 1, a printer 10 according to the embodiment is configured to record images on sheets of paper based on an inkjet recording method of ejecting ink droplets toward the sheets. The printer 10 includes a recording head 21, a cartridge-attachment portion 110, and ink tubes 20. Ink cartridges 30 storing ink to be supplied to the recording head 21 are detachably attachable to the cartridge-attachment portion 110. The ink tubes 20 connect the recording head 21 to the cartridge-attachment portion 110. An opening 112 is formed in one end of the cartridge-attachment portion 110. The ink cartridge 30 and the cartridge-attachment section 110 of the printer 10 constitute a system of the present disclosure.

Figure 9:
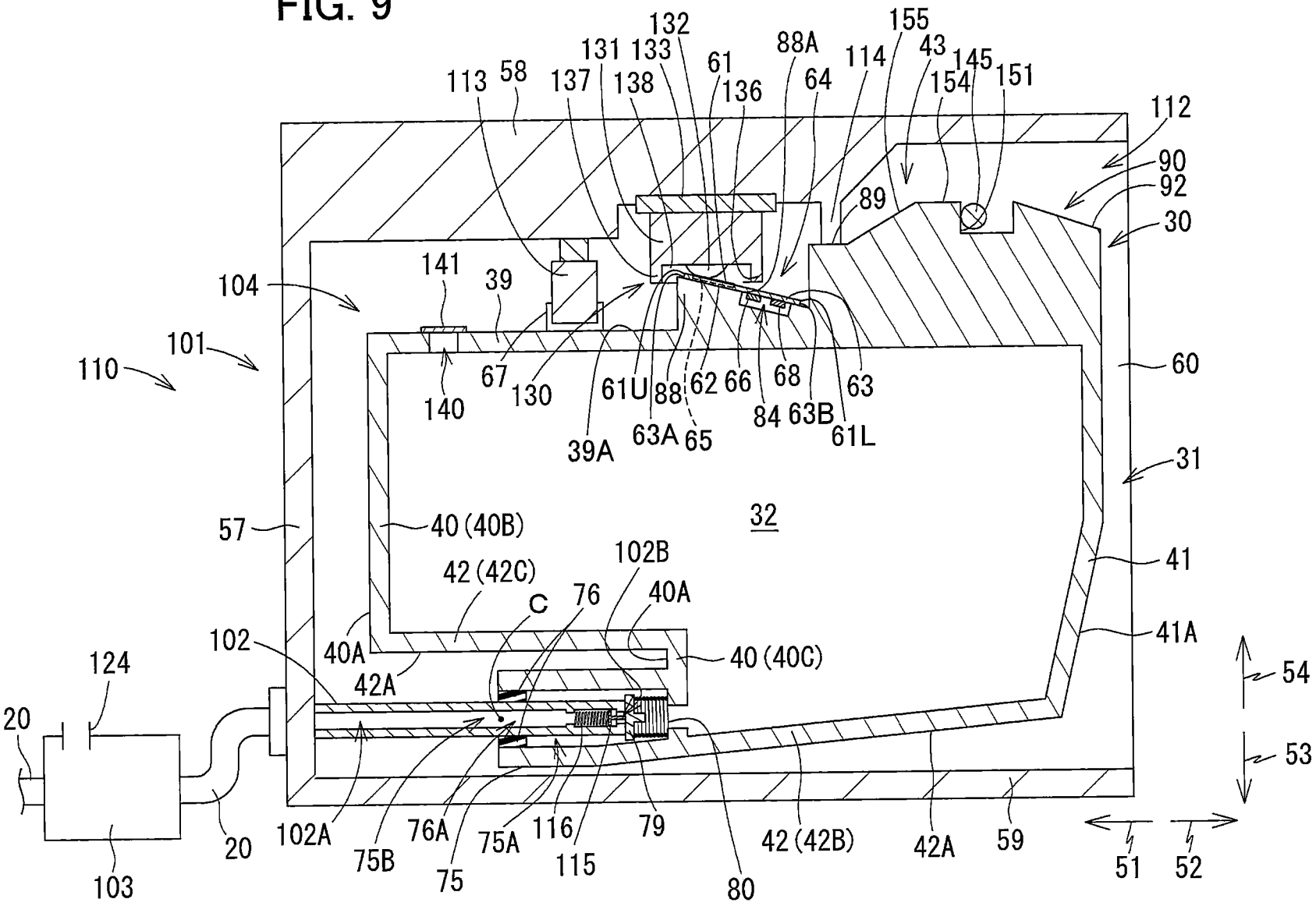
FIG. 9 is a vertical cross-sectional view of the ink cartridge according to the embodiment attached to the cartridge-attachment section, the ink cartridge being in the upright posture.

The ink cartridges 30 are inserted into the cartridge-attachment portion 110 through the opening 112 in order to be attached to the cartridge-attachment portion 110. The ink cartridges 30 are also extracted from the cartridge-attachment portion 110 through the opening 112. FIG. 1 shows one of the ink cartridges 30 in its attached state in the cartridge-attachment portion 110, i.e., when the ink cartridge 30 has been completely attached to the cartridge-attachment portion 110. FIG. 9 shows the ink cartridge 30 and cartridge-attachment portion 110 of FIG. 1. That is, FIG. 9 shows the attached state of the ink cartridge 30.

In the following description, as shown in FIG. 9, a frontward direction 51 is defined as a direction in which the ink cartridge 30 is inserted into the cartridge-attachment portion 110. Further, a posture of the ink cartridge 30 when being inserted forward into and attached to the cartridge-attachment portion 110 is defined as an upright posture. Hence, when in its attached state, the ink cartridge 30 is in the upright posture. FIGS. 1 and 4 through 9 illustrate the ink cartridge 30 in this upright posture. A rearward direction 52 is defined as a direction opposite the frontward direction 51, and is a direction in which the ink cartridge 30 is extracted from the cartridge-attachment portion 110. In the present embodiment, a horizontal direction is defined as a direction orthogonal to the direction of gravity and parallel to the insertion direction. Both the frontward direction 51 and rearward direction 52 are parallel to the horizontal direction (direction orthogonal to the direction of gravity). The frontward direction 51 and rearward direction 52 intersect the direction of gravity. Further, a downward direction 53 is defined as the direction of gravity, and an upward direction 54 is defined as a direction opposite the direction of gravity. As shown in FIGS. 5A and 5B, a rightward direction 55 and a leftward direction 56 are defined as directions orthogonal to the frontward direction 51 and downward direction 53. More specifically, when the ink cartridge 30 is in its upright posture (the attached state shown in FIG. 1), the rightward direction 55 is defined as a direction extending rightward and the leftward direction 56 as a direction extending leftward when the ink cartridge 30 is viewed from the rear, as illustrated in FIG. 5A.

Further, in the following description, the frontward direction 51 and rearward direction 52 are collectively referred to as a front-rear direction, the upward direction 54 and downward direction 53 are collectively referred to as a vertical direction, and the rightward direction 55 and leftward direction 56 are collectively referred to as a left-right direction.

In the state where the ink cartridge 30 is completely attached to the cartridge-attachment portion 110, the ink cartridge 30 has a height in the up-down direction; a depth in the front-rear direction (i.e., in the insertion direction); and a width in the left-right direction (i.e., widthwise direction).

When the ink cartridge 30 is in its upright posture, the width direction of the ink cartridge 30 corresponds to the left-right direction, the height direction of the ink cartridge 30 corresponds to the vertical direction, and the depth direction of the ink cartridge 30 corresponds to the front-rear direction.

While in its upright posture, the ink cartridge 30 is inserted forward into the cartridge-attachment portion 110 through the opening 112 (see FIGS. 7 and 8) until the ink cartridge 30 is mounted in the cartridge-attachment portion 110 (see FIG. 9). The ink cartridge 30 is also extracted rearward from the cartridge-attachment portion 110 while in its upright posture.

The ink cartridge 30 stores ink that the printer 10 can use for printing. As shown in FIG. 1, the ink cartridge 30 is connected to the recording head 21 by the ink tube 20 when the ink cartridge 30 is in its attached state in the cartridge-attachment portion 110. The recording head 21 includes sub-tanks 28, and nozzles 29. Each of the sub-tanks 28 temporarily holds ink to be supplied through the corresponding ink tube 20. The recording head 21 ejects ink supplied from the sub-tanks 28 through the nozzles 29 according to an inkjet recording method. More specifically, the recording head 21 includes a head control board (not shown), and piezoelectric elements 29A corresponding one-on-one to the nozzles 29. The head control board selectively applies drive voltages to the piezoelectric elements 29A in order to eject ink from the nozzles 29.

The printer 10 also includes a sheet tray 15, a feed roller 23, a conveying path 24, a pair of conveying rollers 25, a platen 26, a pair of discharge rollers 27, and a discharge tray 16. The feed roller 23 feeds each of the sheets from the sheet tray 15 onto the conveying path 24, and the conveying rollers 25 convey the sheet over the platen 26. The recording head 21 ejects ink onto the sheet as the sheet passes over the platen 26, whereby an image is recorded on the sheet. The discharge rollers 27 receive the sheet that has passed over the platen 26 and discharge the sheet into the discharge tray 16 provided on a downstream end of the conveying path 24.

<Cartridge-Attachment Portion 110>

Figure 2:
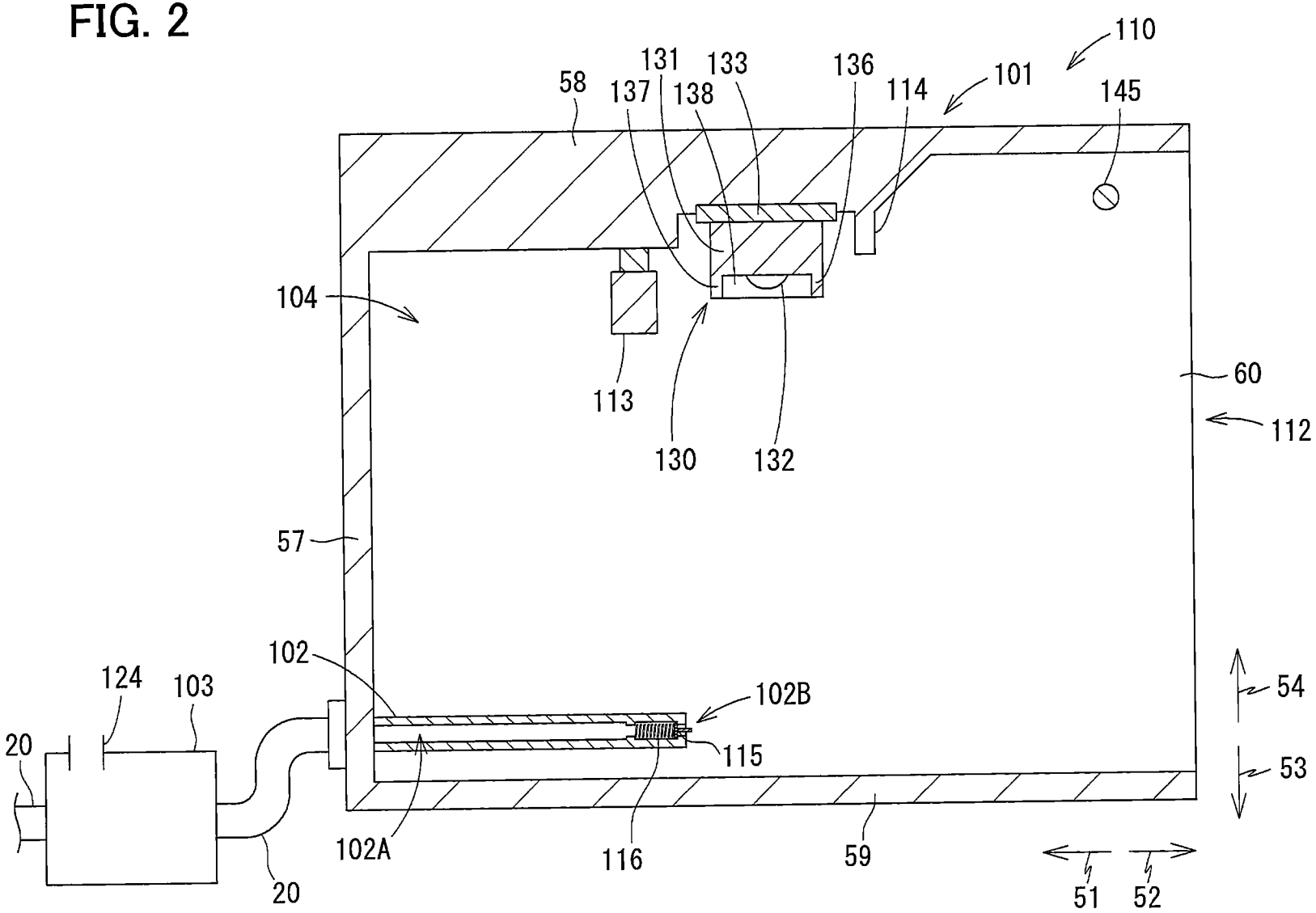
FIG. 2 is a vertical cross-sectional view of a cartridge-attachment section according to the embodiment.

As shown in FIG. 2, the cartridge-attachment portion 110 includes a cartridge holder 101, a cover 111, a cover sensor 118, tubes 102, a shaft 145, tanks 103, optical sensors 113, protruding parts 114, and connectors 130.

<Cartridge Holder 101>

The cartridge holder 101 shown in FIG. 2 constitutes a casing of the cartridge-attachment portion 110. The cartridge holder 101 has a box shape. An interior space 104 is formed inside the cartridge holder 101.

As shown in FIG. 2, the cartridge holder 101 is provided with an end wall 57, a bottom wall 59, a top wall 58, and a pair of side walls 60. The bottom wall 59 extends rearward from a bottom edge of the end wall 57. The top wall 58 extends rearward from a top edge of the end wall 57 and is separated vertically from the bottom wall 59. The side walls 60 extend rearward from respective right and left edges of the end wall 57. The side wall 60 extending from the right edge of the end wall 57 is connected to right edges of the bottom wall 59 and top wall 58, while the side wall 60 extending from the left edge of the end wall 57 is connected to left edges of the bottom wall 59 and top wall 58. Hence, the side walls 60 connect the top wall 58 to the bottom wall 59.

The opening 112 is formed in a rear end of the cartridge holder 101 to oppose the end wall 57 in the front-rear direction. The opening 112 is in communication with the interior space 104 of the cartridge holder 101. A user faces the opening 112 when using the printer 10.

The interior space 104 of the cartridge holder 101 is defined by the end wall 57, bottom wall 59, top wall 58, and side walls 60. Partitioning walls (not shown) partition the interior space 104 into four compartments. One each of the tubes 102, tanks 103, optical sensors 113, protruding parts 114, and connector 130 is provided in each compartment of the partitioned interior space 104. Note that the number of compartments in the interior space 104 is not limited to four.

<Tubes 102>

The tube 102 shown in FIG. 2 is a cylindrically shaped member formed of a resin. As shown in FIG. 2, the tubes 102 are located in a lower portion of the end wall 57 constituting the cartridge holder 101. The tubes 102 protrude farther rearward than the end wall 57 of the cartridge holder 101. A rear end (distal end) and a front end (proximal end) of each tube 102 are both open.

The tube 102 has an interior space 102A. A valve 115 and a coil spring 116 are accommodated in the interior space 102A. By moving in the front-rear direction, the valve 115 opens and closes an opening 102B formed in the distal end of the tube 102. The coil spring 116 urges the valve 115 rearward. Hence, when an external force is not being applied to the valve 115 (when the ink cartridge 30 is not mounted in the cartridge-attachment portion 110), the valve 115 closes the opening 102B. Further, when an external force is not being applied to the valve 115, a rear end of the valve 115 urged by the coil spring 116 protrudes rearward from the opening 102B.

Notches (not shown) are formed in a peripheral wall of the tube 102 at the distal end thereof, and specifically in a portion of the peripheral wall positioned rearward from a part of the valve 115 that closes the opening 102B, i.e., a front end of the valve 115.

<Shaft 145>

As shown in FIG. 2, the shaft 145 extends in the left-right direction near the top wall 58 of the cartridge holder 101 and near the opening 112. The shaft 145 is a rod-shaped member that extends in the left-right direction through the interior space 104 of the cartridge holder 101. The shaft 145 is a metal rod, for example. Left and right ends of the shaft 145 are fixed to the side walls 60 of the cartridge holder 101.

<Cover 111>

As shown in FIG. 1, the cover 111 is provided near the opening 112 formed in the cartridge holder 101. The cover 111 is capable of covering the opening 112 or exposing the opening 112 to the outside by closing and opening on the cartridge holder 101. The cover 111 is supported on a pivot shaft 109 that extends in the left-right direction near a portion of the cartridge holder 101 defining a bottom edge of the opening 112. With this construction, the cover 111 is capable of pivoting from a closed position (see FIG. 1) for covering the opening 112 to an open position so that a top edge of the cover 111 moves forward. When the cover 111 is in the open position, the user can insert ink cartridges 30 into the cartridge holder 101 through the opening 112 formed in the cartridge holder 101. When the cover 111 is in the closed position, the user cannot insert ink cartridges 30 into or extract ink cartridges 30 from the cartridge holder 101.

<Tanks 103>

As shown in FIG. 2, the tanks 103 are provided frontward of the cartridge holder 101. Each tank 103 has a box shape and can accommodate ink internally. The tank 103 has a top portion that is open to the outside through an air communication port 124. Accordingly, the interior of the tank 103 is open to the atmosphere. The interior space in the tank 103 is in communication with the front end of the corresponding tube 102 via the corresponding ink tube 20. With this arrangement, ink flowing out of the interior space 102A of the tube 102 is accumulated in the tank 103. The interior space of the tank 103 is also in communication with the recording head 21 via the corresponding ink tube 20. Accordingly, ink stored in the interior of the tank 103 is supplied to the recording head 21 through the corresponding ink tube 20.

Note that the cartridge-attachment portion 110 need not be provided with the tanks 103. In this case, the front ends of the tubes 102 communicate with the recording head 21 via the ink tubes 20 without passing through the tanks 103.

<Optical Sensors 113>

As shown in FIG. 2, the optical sensors 113 are disposed near the top wall 58 of the cartridge holder 101. The optical sensors 113 are positioned farther forward than the shaft 145 in the front-rear direction. Each optical sensor 113 includes a light-emitting part and a light-receiving part. The light-emitting part is disposed on the right or left of the light-receiving part with a gap formed therebetween. The light-emitting part is configured to emit light toward the light-receiving part in the left-right direction.

The optical sensors 113 is configured to output detection signals to a controller 1 (see FIG. 1). The signals differ according to whether the corresponding light-receiving part receives light emitted from the corresponding light-emitting part. For example, the optical sensor 113 outputs a low level signal to the controller 1 when the light-receiving part cannot receive light emitted from the light-emitting part (that is, when the received light is less than a prescribed intensity) and outputs a high level signal to the controller 1 when the light-receiving part can receive light emitted from the light-emitting part (that is, when the received light is greater than or equal to the prescribed intensity). Here, the controller 1 is a device for controlling operations of the printer 10 and is configured of a CPU, ROM, and RAM, for example.

<Cover Sensor 118>

The cover sensor 118 is disposed on the cartridge holder 101 near the top edge of the opening 112. The cover sensor 118 includes a light-emitting part and a light-receiving part. When the cover 111 is in the closed position, a part of the cover 111 is disposed in an optical path of the light traveling from the light-emitting part toward the light-receiving part, blocking the light from reaching the light-receiving part in the cover sensor 118. Accordingly, the cover sensor 118 outputs a low level signal to the controller 1. When the cover 111 is not in the closed position, that is, when the cover 111 is in a position separated from the cover sensor 118, the cover 111 does not interrupt light traveling from the light-emitting part to the light-receiving part, and the cover sensor 118 outputs a high level signal to the controller 1.

<Protruding Parts 114>

As shown in FIG. 2, the protruding parts 114 protrude downward from the top wall 58 of the cartridge holder 101. The protruding parts 114 are disposed rearward of the corresponding optical sensors 113 and forward of the shaft 145 in the front-rear direction.

<Connectors 130>

Figure 3A:
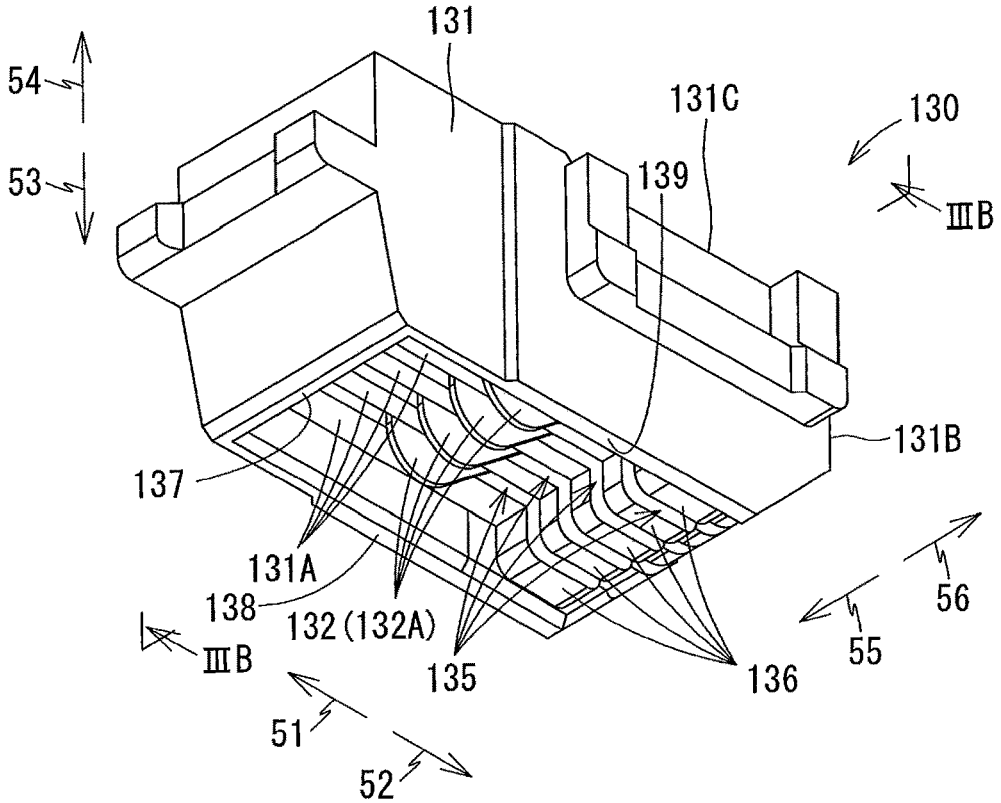
FIG. 3A is a perspective view of a connector of the cartridge-attachment section according to the embodiment.
Figure 3B:
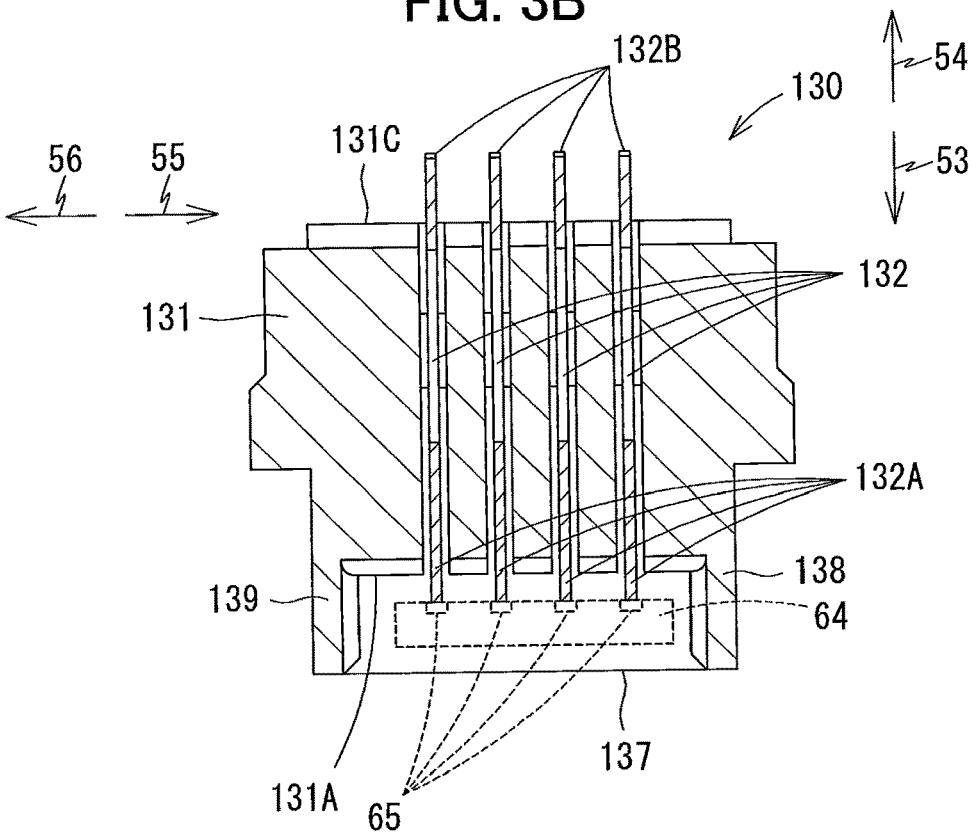
FIG. 3B is a cross-sectional view of the connector according to the embodiment taken along a plane IIIB-IIIB shown in FIG. 3A.

As shown in FIGS. 2 through 3B, each of the connectors 130 includes contacts 132, and a case 131 accommodating the contacts 132.

As shown in FIG. 2, a circuit board 133 is fixed to the cartridge holder 101 in proximity to the top wall 58. The circuit board 133 is positioned farther rearward than the tubes 102 and optical sensors 113 and farther forward than the shaft 145 and protruding parts 114. The circuit board 133 is fixed to the cartridge holder 101. The cases 131 of the connectors 130 are fixed to a bottom surface of the circuit board 133 with screws, solder, or the like (not shown). Hence, the connectors 130 are fixed to the cartridge holder 101 via the circuit board 133. Note that the connectors 130 need not be fixed to the cartridge holder 101. For example, the connectors 130 may be removably fitted into or otherwise attached to the bottom surface of the circuit board 133.

As shown in FIGS. 3A and 3B, the case 131 of each connector 130 has a general rectangular parallelepiped shape. Slots 135 are formed in the case 131 from a bottom surface 131A to a top surface 131C. The slots 135 also pass through a rear surface 131B of the case 131. Four of the slots 135 are formed at intervals in the left-right direction. The four slots 135 provide four internal spaces in the case 131. A single contact 132 is disposed in each of the four internal spaces. Thus, the connector 130 includes four contacts 132. Note that the number of slots 135 is not limited to four. That is, the number of contacts 132 provided in the connector 130 is not limited to four.

The case 131 supports the contacts 132 in the corresponding internal spaces formed by the slots 135. The contacts 132 are configured of members that are flexible and electrically conductive. Bottom ends 132A of the contacts 132 protrude farther downward than the bottom surface 131A of the case 131. The bottom ends 132A of the contacts 132 can be elastically deformed upward.

Top ends 132B of the contacts 132 (see FIG. 3B) are mounted on the circuit board 133. Through this construction, the contacts 132 are electrically connected to an electric circuit mounted on the same circuit board 133. In other words, electricity can be conducted between the contacts 132 and the electric circuit. This electric circuit is also electrically connected to the controller 1 (see FIG. 1).

The case 131 also includes a rear wall 136, a front wall 137, a right wall 138, and a left wall 139. The rear wall 136, front wall 137, right wall 138, and left wall 139 protrude downward from the bottom surface 131A of the case 131. Bottom edges of the rear wall 136, front wall 137, right wall 138, and left wall 139 are thus positioned lower than bottom edges of the contacts 132. Note that at least one of the right wall 138 and left wall 139 may be omitted from the case 131.

The rear wall 136 is positioned farther rearward than the bottom ends 132A of the contacts 132. The front wall 137 is positioned farther forward than the bottom ends 132A of the contacts 132. The rear wall 136 and front wall 137 are aligned with each other in the front-rear direction. The right wall 138 is positioned farther rightward than the bottom ends 132A of the contacts 132, and the left wall 139 is positioned farther leftward than the bottom ends 132A of the contacts 132. The right wall 138 and left wall 139 are aligned with each other in the left-right direction. A front edge of the right wall 138 is connected to a right edge of the front wall 137, and a rear edge of the right wall 138 is connected to a right edge of the rear wall 136. A front edge of the left wall 139 is connected to a left edge of the front wall 137, and a rear edge of the left wall 139 is connected to a left edge of the rear wall 136.

<Ink Cartridge 30>

Figure 4:
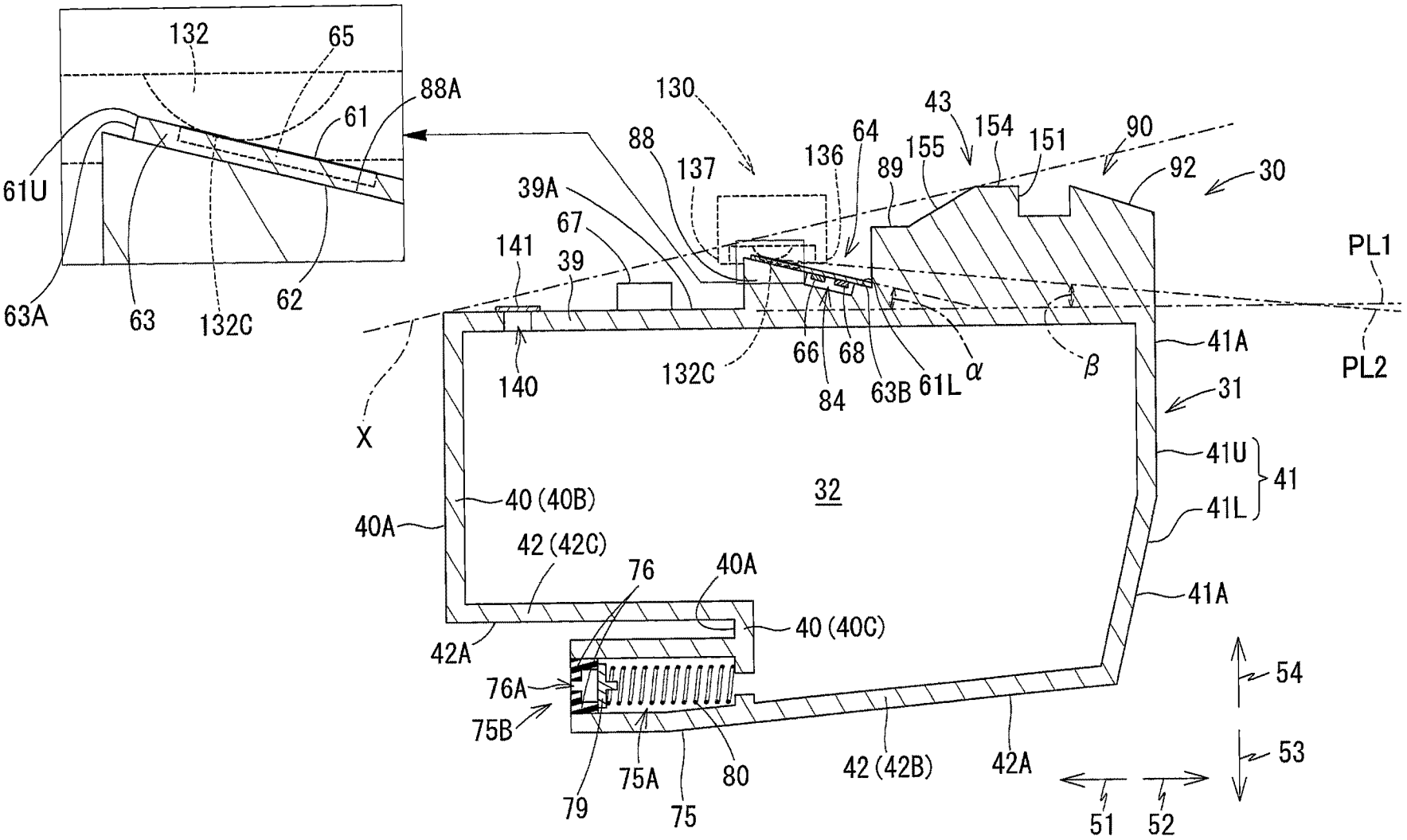
FIG. 4 is a vertical cross-sectional view of an ink cartridge according to the embodiment in an upright posture.
Figure 5B:
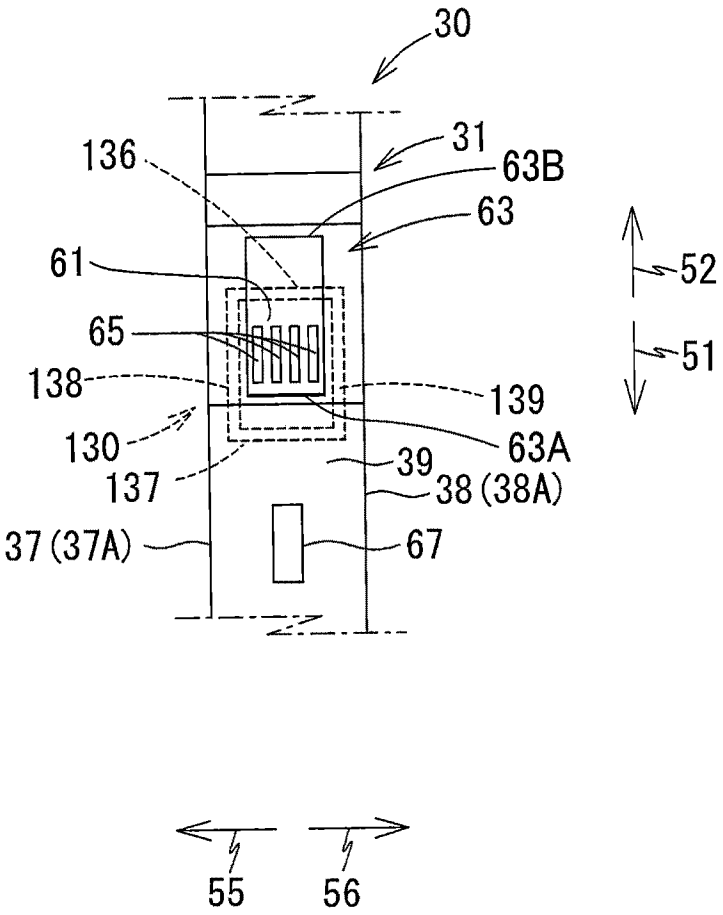
FIG. 5B is a partially-enlarged plan view of the ink cartridge according to the embodiment in the upright posture.
Figure 5A:
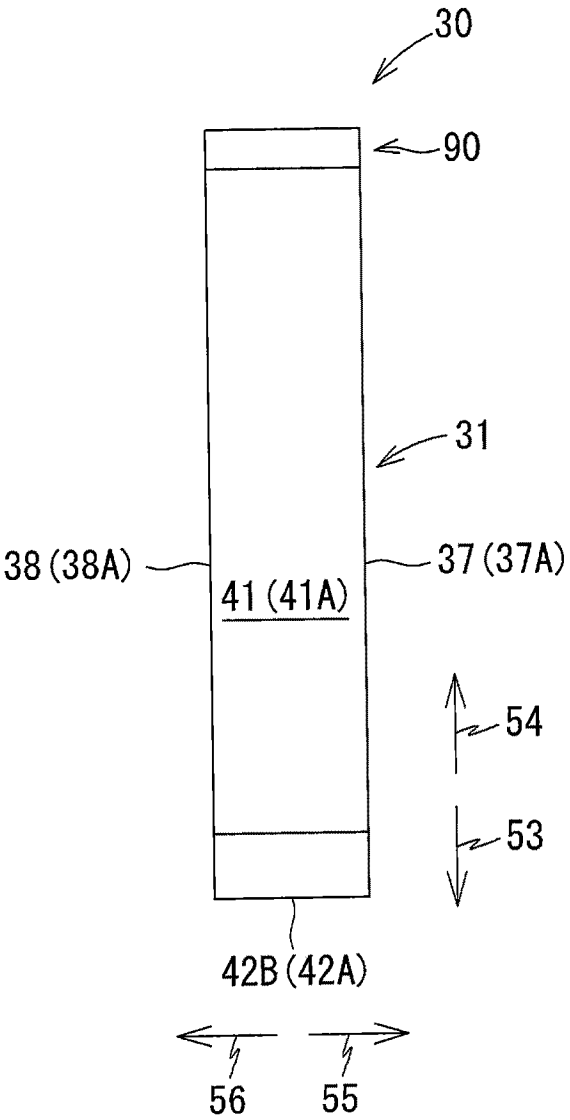
FIG. 5A is a rear side view of the ink cartridge according to the embodiment in the upright posture.
Figure 6:
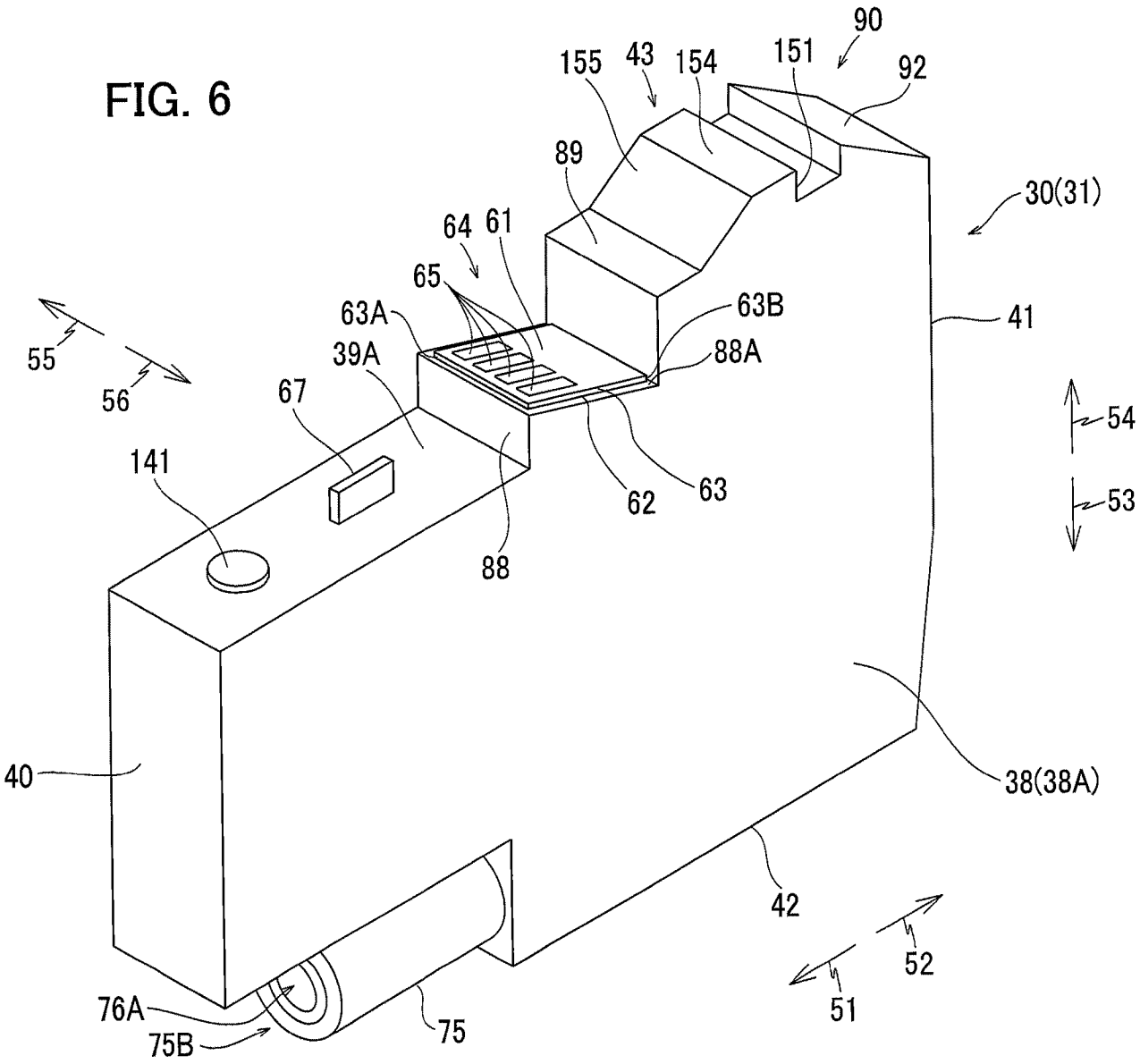
FIG. 6 is a perspective view of the ink cartridge according to the embodiment.

The ink cartridge 30 shown in FIGS. 4 to 6 is a container that stores ink. One ink cartridge 30 is accommodated in each of the four compartments partitioned in the interior space 104 of the cartridge holder 101 (see FIG. 2). Thus, four ink cartridges 30 can be accommodated in the cartridge-attachment portion 110 in the present embodiment. Each of the four ink cartridges 30 corresponds to one of the ink colors cyan, magenta, yellow, and black. Ink in one of these colors is stored in the corresponding ink cartridge 30. Note that the number of ink cartridges 30 that the cartridge-attachment portion 110 can accommodate is not limited to four.

As shown in FIGS. 4 to 6, the ink cartridge 30 includes a housing 31, a sealing member 76, a protruding part 43, an operating part 90, a projection 67, a protruding part 88, and a circuit board 64.

<Housing 31>

The housing 31 is configured of a front wall 40, a rear wall 41, a top wall 39, a bottom wall 42, and a pair of side walls 37 and 38. The front wall 40 and rear wall 41 are separated from each other in the front-rear direction. The top wall 39 is arranged between the front wall 40 and rear wall 41 and extends from a top edge of the front wall 40 to a top edge of the rear wall 41. The bottom wall 42 is arranged between the front wall 40 and rear wall 41 and extends from a bottom edge of the front wall 40 to a bottom edge of the rear wall 41. The top wall 39 and bottom wall 42 are separated from each other in the direction of gravity. The side wall 37 and side wall 38 are separated from each other in the left-right direction. Peripheral edges of the side walls 37 and 38 are connected to the front wall 40, rear wall 41, top wall 39, and bottom wall 42.

In a state where the ink cartridge 30 is in its upright posture, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56. Also in this upright posture, a front surface 40A of the front wall 40 faces forward, a rear surface 41A of the rear wall 41 faces rearward, a bottom surface 42A of the bottom wall 42 faces downward, a top surface 39A of the top wall 39 faces upward, a right surface 37A of the side wall 37 faces rightward, and a left surface 38A of the side wall 38 faces leftward.

The front wall 40 is configured of a front wall 40B, and a front wall 40C positioned farther rearward than the front wall 40B. That is, a front surface of the front wall 40B and a front surface of the front wall 40C constitute the front surface 40A of the front wall 40.

The bottom wall 42 is configured of a bottom wall 42B, and a bottom wall 42C positioned higher than the bottom wall 42B. A bottom surface of the bottom wall 42B and a bottom surface of the bottom wall 42C constitute the bottom surface 42A of the bottom wall 42. The bottom wall 42C extends continuously rearward from a bottom edge of the front wall 40B. The bottom wall 42B and bottom wall 42C are joined through the front wall 40C. The bottom surface of the bottom wall 42B is a sloped surface that slopes relative to the front-rear direction so that its front edge is lower than its rear edge.

The rear wall 41 is configured of an upper portion 41U, and a lower portion 41L. The upper portion 41U is positioned above the lower portion 41L. The lower portion 41L is positioned farther forward than the upper portion 41U. Both the upper portion 41U and lower portion 41L are flat surfaces. The upper portion 41U and lower portion 41L extend in directions that intersect but are not orthogonal to each other. The lower portion 41L slopes relative to the vertical direction, and specifically slopes forward from top to bottom.

Unless otherwise specified, it will be assumed that the ink cartridge 30 is in its upright posture in the following description. In other words, the vertical, front-rear, and left-right directions for the ink cartridge 30 are defined based on the ink cartridge 30 being in the upright posture.

The ink cartridge 30 has an overall flattened shape in which a left-right dimension thereof (width) is smaller than a front-rear dimension thereof (depth), and the vertical and front-rear dimensions (height and depth) are larger than the left-right dimension (width).

The ink cartridge 30 is mounted in the cartridge holder 101 by inserting the ink cartridge 30 forward through the opening 112 formed in the cartridge holder 101 of the cartridge-attachment portion 110 and is removed from the cartridge holder 101 by pulling the ink cartridge 30 rearward through the opening 112.

As shown in FIG. 4, the housing 31 defines therein a storage chamber 32 for storing ink. The storage chamber 32 is positioned between the front wall 40 and rear wall 41, between the top wall 39 and bottom wall 42, and between the pair of side walls 37 and 38. In the present embodiment, the storage chamber 32 is defined by a surface of the front wall 40 opposite the front surface 40A (rear surface of the front wall 40), a surface of the rear wall 41 opposite the rear surface 41A (front surface of the rear wall 41), a surface of the top wall 39 opposite the top surface 39A (lower surface of the top wall 39), and a surface of the bottom wall 42 opposite the bottom surface 42A (upper surface of the bottom wall 42).

In the housing 31, at least the rear wall 41 has a light-transmission capability so that a level of ink stored in the storage chamber 32 is visible from the outside.

The housing 31 includes the cylinder 75 that protrudes forward from the front surface of the front wall 40C. The cylinder 75 is elongated in the front-rear direction. A passage 75A extending in the front-rear direction is formed inside the cylinder 75. That is, the direction in which the cylinder 75 and passage 75A extend (front-rear direction) is aligned with the insertion direction of the ink cartridge 30. An opening 75B is formed in a front end of the cylinder 75 and in communication with the passage 75A. The passage 75A has a rear end in communication with the storage chamber 32. That is, the passage 75A is open at its rear end on the front surface of the front wall 40C. In other words, the passage 75A is open frontward at the front wall 40. Hence, the passage 75A penetrates the front wall 40.

The passage 75A accommodates a valve 79, and a coil spring 80. The valve 79 opens and closes the opening 75B by moving in the front-rear direction. The coil spring 80 urges the valve 79 rearward. Therefore, when an external force is not applied to the valve 79, the valve 79 firmly contacts the sealing member 76 fitted in the opening 75B. However, when an external force is applied to the valve 79, the valve 79 separates from the sealing member 76, allowing ink stored in the storage chamber 32 to be supplied through the passage 75A and out through the opening 75B in the cylinder 75. Note that a structure for switching opening and closing of the opening 75B is not limited to the structure configured of the valve 79. For example, the opening 75B may be closed by a seal adhered to the cylinder 75.

An air communication port 140 is formed in the top wall 39 of the housing 31. A seal 141 seals the air communication port 140 prior to the ink cartridge 30 being inserted into the cartridge-attachment portion 110. The seal 141 can be peeled off the air communication port 140. By peeling the seal 141 off the air communication port 140 before inserting the ink cartridge 30 into the cartridge-attachment portion 110, the storage chamber 32 is able to communicate with the external air via the air communication port 140. Note that communication between the storage chamber 32 and external air may be achieved through means not involving peeling off the seal 141. For example, a valve may be provided in the air communication port 140, and the valve may be used to switch communication between the storage chamber 32 and the outside air on and off.

The front wall 40, rear wall 41, top wall 39, bottom wall 42, and side walls 37 and 38 may be configured of a plurality of walls in the same manner as the front wall 40 in the embodiment, or may be configured of single walls in the manner of the rear wall 41.

Further, the surfaces of the ink cartridge 30 including the front surface 40A of the front wall 40, rear surface 41A of the rear wall 41, top surface 39A of the top wall 39, bottom surface 42A of the bottom wall 42, right surface 37A of the side wall 37, and left surface 38A of the side wall 38 need not be formed as single flat surfaces.

The front surface 40A of the front wall 40 is a surface of the housing 31 that is visible when viewing the ink cartridge 30 in its upright posture from the front side. According to a concept of the present disclosure, a front surface includes: a surface of the housing 31 positioned farthest forward (the front surface 40A); and a surface positioned forward of a halfway point in the front-rear direction between the forwardmost surface and a rearmost surface of the housing 31 (the rear surface 41A).

The rear surface 41A of the rear wall 41 is a surface of the housing 31 that is visible when viewing the ink cartridge 30 in its upright posture from the rear side. The concept of a rear surface in the present disclosure includes: a surface of the housing 31 positioned farthest rearward (the rear surface 41A); and a surface positioned rearward of the halfway point in the front-rear direction between the rearmost surface and the forwardmost surface of the housing 31 (front surface 40A).

The top surface 39A of the top wall 39 is a surface of the housing 31 that is visible when viewing the ink cartridge 30 in its upright posture from above. The concept of the top surface in the present disclosure includes: a topmost surface of the housing 31 (the top surface 39A); and a surface above a vertical halfway point between this topmost surface and a bottommost surface of the housing 31 (the bottom surface 42A).

The bottom surface 42A of the bottom wall 42 is a surface of the housing 31 that is visible when viewing the ink cartridge 30 in its upright posture from below. The concept of the bottom surface in the present disclosure includes: the bottommost surface of the housing 31 (the bottom surface 42A); and a surface below the vertical halfway point between this bottommost surface and the topmost surface of the housing 31 (the top surface 39A).

The right surface 37A of the side wall 37 is a surface of the housing 31 that is visible when viewing the ink cartridge 30 in its upright posture from the right side.

The left surface 38A of the side wall 38 is a surface of the housing 31 that is visible when viewing the ink cartridge 30 in its upright posture from the left side.

<Sealing Member 76>

The sealing member 76 shown in FIG. 4 is configured of an elastic member formed of rubber or the like. The sealing member 76 is a ring-shaped member with a circular through-hole 76A formed in a center thereof. The through-hole 76A has a diameter smaller than an outer diameter of the tube 102 in the cartridge-attachment portion 110 (see FIG. 2). As shown in FIG. 4, the sealing member 76 is disposed near the opening 75B of the cylinder 75 so that the through-hole 76A is at the same position as the opening 75B in the front-rear direction. The sealing member 76 has an outer diameter larger than a diameter of the opening 75B. Accordingly, when the sealing member 76 is fitted into the opening 75B, a hermetic seal is formed between the sealing member 76 and the cylinder 75 to provide a light-tight seal therebetween.

The sealing member 76 is prevented from coming out of the cylinder 75 by well-known means. For example, the sealing member 76 may be fixed in the cylinder 75 by interposing the sealing member 76 between the cylinder 75 and a cap (not shown) placed over the cylinder 75, or may be fixed in the cylinder 75 by adhesive.

<Protruding Part 43>

As shown in FIG. 4, the protruding part 43 is formed on a rear portion of the top surface 39A of the top wall 39. The protruding part 43 protrudes upward and is elongated in the front-rear direction. The protruding part 43 has a rear end face 151 facing rearward which serves as a lock surface 151.

The protruding part 43 also includes a horizontal surface 154 that extends continuously forward from the lock surface 151. The horizontal surface 154 expands in both the left-right and front-rear directions. The protruding part 43 also includes a sloped surface 155 that is forward of and continuous with the horizontal surface 154. The sloped surface 155 slopes relative to the front-rear direction, and specifically slopes downward toward the front.

The protruding part 43 also includes a positioning surface 89. The positioning surface 89 is formed frontward of the sloped surface 155. The positioning surface 89 faces upward.

<Operating Part 90>

As shown in FIG. 4, the operating part 90 is formed on the top wall 39 at a position rearward of the lock surface 151. The operating part 90 has an operating surface 92. The user operates the operating part 90 in order to pull the ink cartridge 30 mounted in the cartridge holder 101 rearward.

<Projection 67>

As shown in FIG. 4, the projection 67 is provided on the top surface 39A of the top wall 39. The projection 67 protrudes upward from the top surface 39A and is elongated in the front-rear direction. The projection 67 is positioned forward of the positioning surface 89. When viewed in the left-right direction, the projection 67 is positioned lower than a virtual plane X that is the highest among virtual planes passing through the upper-front corner of the housing 31 and the protruding part 43.

Light emitted by the optical sensor 113 of the cartridge-attachment portion 110 (see FIG. 2) is incident on either a right surface or a left surface of the projection 67. The surface of the projection 67 on which light is incident will be called a "light-blocking surface". In the present embodiment, the projection 67 is a plate formed of a resin material that contains a color material (black pigment) capable of blocking or absorbing light, for example. As a variation, a material that prevents the passage of light such as aluminum foil may be affixed to at least the light-blocking surface of the projection 67.

<Protruding Part 88>

As shown in FIG. 4, the protruding part 88 is formed on the top surface 39A of the top wall 39 at a position rearward of the projection 67. The protruding part 88 is positioned frontward of the protruding part 43. A top edge (front edge) of the protruding part 88 is lower than the top edge of the protruding part 43. The protruding part 88 has a top surface 88A sloping relative to a virtual plane PL1 that extends in the front-rear and left-right directions. Specifically, the top surface 88A slopes upward toward the front side.

Although the protruding part 88 (as an example of a substrate retaining part) is formed integrally with the top wall 39 in the embodiment, the substrate retaining part may be a separate member instead. For example, the substrate retaining part may be an adapter that is attached to the top wall 39.

<Circuit Board 64>

As shown in FIG. 4, the circuit board 64 (more accurately, a substrate 63 thereof) is supported from below by the top surface 88A of the protruding part 88.

The circuit board 64 includes the substrate 63, a memory 66, a battery 68, and electrodes 65. The circuit board 64 is positioned rearward of the projection 67 and forward of the protruding part 43. The circuit board 64 is also positioned farther rearward than the sealing member 76 in the front-rear direction. More specifically, the circuit board 64 is positioned farther rearward than the through-hole 76A formed in the sealing member 76. The circuit board 64 is also positioned below the virtual plane X described above in the vertical direction. The storage chamber 32 is vertically interposed between the circuit board 64 and the bottom surface 42A of the bottom wall 42.

The substrate 63 of the circuit board 64 is a rigid substrate formed of a glass epoxy or the like. The circuit board 64 is configured by mounting the memory 66 and battery 68 on the substrate 63 and forming four electrodes 65 on the substrate 63 (see FIG. 5B).

Note that the number of electrodes 65 is determined based on the number of the contacts 132 in the cartridge-attachment portion 110 (see FIG. 2) and is not limited to four. Further, the battery 68 need not be mounted on the circuit board 64.

The substrate 63 has a length in the front-rear direction that is greater than a width thereof in the left-right direction. Preferably, the front-rear dimension of the substrate 63 is at least two times greater than the left-right dimension, and more preferably at least three times greater than the left-right dimension. Note that the front-rear dimension of the substrate 63 may be less than two times the left-right direction or even less than or equal to the left-right dimension.

Specifically, the substrate 63 has a front end face 63A and a rear end face 63B opposite each other in the front-rear direction. In the present embodiment, the front end face 63A also constitutes an upper end face of the substrate 63, whereas the rear end face 63B also constitutes a lower end face of the substrate 63. As illustrated in FIGS. 4, 5B and 9, the front-rear dimension of the substrate 63 (a distance between the front end face 63A and the rear end face 63B in the front-rear direction) is greater than a gap formed in the front-rear direction between the front wall 137 and rear wall 136 of the connector 130 in the cartridge-attachment portion 110. Further, as shown in FIG. 5B, the left-right dimension of the substrate 63 is shorter than a gap in the left-right direction between the right wall 138 and left wall 139 of the connector 130.

As illustrated in FIG. 4, the substrate 63 has a first surface 61 (sloped surface), and a second surface 62. The first surface 61 is exposed to the outside of the ink cartridge 30. The second surface 62 is a surface opposite the first surface 61.

The substrate 63 is bonded to the top surface 88A of the protruding part 88 (i.e., to the top surface 39A of the top wall 39) with a photopolymer. However, the circuit board 64 may be bonded to the top surface 88A with an adhesive other than a photopolymer. Still alternatively, the substrate 63 may be mounted on the top surface 88A by means other than adhesives, such as thermal caulking. Note that when thermal caulking is used to mount the circuit board 64 on the top surface 88A, each of the four corners of the circuit board 64 is preferably fixed to the top surface 88A; that is, each of the right-front corner, left-front corner, right-rear corner, and left-rear corner in a plan view. However, it should be obvious that the positions subjected to the thermal caulking need not be limited to these four corners.

Since the top surface 88A of the protruding part 88 slopes relative to the virtual plane PL1 such that the top surface 88A slopes upward toward the front in the front-rear direction, the first surface 61 and second surface 62 of the substrate 63 mounted on the top surface 88A also slope upward toward the front relative to the virtual plane PL1. That is, the substrate 63 is inclined relative to the virtual plane PL1 such that the first surface 61 faces diagonally upward and rearward. Thus, a front edge of the first surface 61 also constitutes an upper edge 61U of the first surface 61, while a rear edge of the first surface 61 serves as a lower edge 61L thereof. In other words, the upper edge 61U is positioned frontward relative to the lower edge 61L. Through this configuration, the protruding part 88 maintains the first surface 61 on the substrate 63 at a desired angle of inclination relative to the virtual plane PL1.

Specifically, referring to FIG. 4, the top surface 88A of the protruding part 88 slopes upward toward the front relative to the virtual plane PL1 and maintains the first surface 61 at an angle $\alpha$ of inclination relative to the virtual plane PL1. Here, the angle $\alpha$ formed by the first surface 61 and the virtual plane PL1 is an acute angle that is greater than an acute angle β formed by a virtual plane PL2 and the virtual plane PL1. The virtual plane PL2 is a plane extending in the left-right direction and passing through portions 132C of the contacts 132 and the bottom edge of the rear wall 136. Here, the portions 132C are portions of the contacts 132 that are in contact with the electrodes 65 to be connected thereto (see FIG. 5B) when the ink cartridge 30 is in its attached state in the cartridge-attachment portion 110 (in the state shown in FIG. 9).

A plurality of electrodes (not shown) is formed on the second surface 62 of the substrate 63. The memory 66 is positioned on some of these electrodes. The battery 68 is positioned on the electrodes that the memory 66 is not mounted. Hence, the memory 66 and battery 68 are mounted on the second surface 62 of the substrate 63.

Here, a depression 84 is formed in the top surface 88A of the protruding part 88 in an area corresponding to the region in which the memory 66 and battery 68 are mounted. In other words, the memory 66 and battery 68 mounted on the second surface 62 are positioned in the depression 84.

Here, referring to FIG. 4, a shortest distance between the front end face 63A (upper end face) of the substrate 63 and the memory 66 is greater than a shortest distance between the rear end face 63B of the substrate 63 and the memory 66. Likewise, a shortest distance between the front end face 63A of the substrate 63 and the battery 68 is also greater than a shortest distance between the front end face 63A of the substrate 63 and the battery 68. In other words, the memory 66 and battery 68 are mounted closer to the rear end face 63B (lower end face) of the substrate 63 than to the front end face 63A of the substrate 63. The battery 68 is mounted at a position diagonally downward and rearward of the memory 66. That is, the battery 68 is positioned lower than the memory 66 in the upright posture of the ink cartridge 30.

The memory 66 stores information related to the ink cartridge 30 that can be read by the controller 1 of the printer 10. The information related to the ink cartridge 30 is data specifying a lot number, a manufactured date, an ink color, and the like. The memory 66 may be a semiconductor memory, such as a Static RAM (SRAM). Note that an integrated circuit (IC) providing function(s) other than a memory may also be mounted on the substrate 63, if necessary.

The electrodes on which the battery 68 is mounted are connected to the electrodes on which the memory 66 is mounted. Hence, the battery 68 is electrically connected to the memory 66, whereby the battery 68 can supply electricity to the memory 66.

As shown in FIG. 3B, each of the four electrodes 65 corresponds to one of the four contacts 132 in the cartridge-attachment portion 110. Hence, the number of electrodes 65, as with the number of contacts 132, is not limited to four. As shown in FIG. 5B, the four electrodes 65 are exposed on the first surface 61 constituting the substrate 63, allowing for electrical connections. Each electrode 65 is elongated in the front-rear direction. The electrodes 65 are arranged parallel to each other and are spaced apart from each other in the left-right direction on the top surface (first surface 61) of the substrate 63. Each electrode 65 is electrically connected to the memory 66.

A shortest distance between the upper edge 61U of the first surface 61 and the electrodes 65 is shorter than a shortest distance between the lower edge 61L of the first surface 61 and the electrodes 65. In other words, the electrodes 65 are formed on the first surface 61 at a position closer to the upper edge 61U (front end face 63A) than to the lower edge 61L (rear end face 63B). The electrodes 65 are also formed in a position diagonally upward and forward relative to the memory 66 and battery 68.

The battery 68 is a button-shaped battery (button cell) in the present embodiment. The battery 68 is electrically connected to the memory 66 and is configured to supply power to the memory 66. Upon receipt of the power supply from the battery 68, the memory 66 (SRAM) can store various data.

Note that, an electronic component other than the battery 68 may be mounted on the substrate 63 for supplying power to the memory 66. For example, a capacitor in a charged state can be employed as another example of the electronic component for supplying power to the memory 66.

<Operations for Attaching the Ink Cartridge 30 to the Cartridge-Attachment Portion 110>

Next, operations for mounting the ink cartridge 30 in the cartridge holder 101 of the cartridge-attachment portion 110 will be described.

FIG. 4 shows the ink cartridge 30 prior to being mounted in the cartridge-attachment portion 110. At this time, the seal 141 seals the air communication port 140 so that the storage chamber 32 is not in communication with the atmosphere. Prior to mounting the ink cartridge 30 in the cartridge-attachment portion 110, the user peels off the seal 141, opening the storage chamber 32 to the atmosphere. Also, prior to the ink cartridge 30 being mounted in the cartridge-attachment portion 110, the valve 79 is in contact with the sealing member 76. Consequently, ink stored in the storage chamber 32 is prevented from flowing out of the ink cartridge 30 through the through-hole 76A.

In a state where the ink cartridge 30 is not attached to the cartridge-attachment portion 110, no member is positioned between the light-emitting part and light-receiving part of the optical sensor 113, enabling light to travel from the light-emitting part to the light-receiving part. At this time, the optical sensor 113 outputs a high level detection signal to the controller 1 (see FIG. 1). Further, prior to attachment of the ink cartridge 30 to the cartridge-attachment portion 110, the valve 115 closes the opening 102B, and the rear end of the valve 115 protrudes rearward from the opening 102B.

Figure 7:
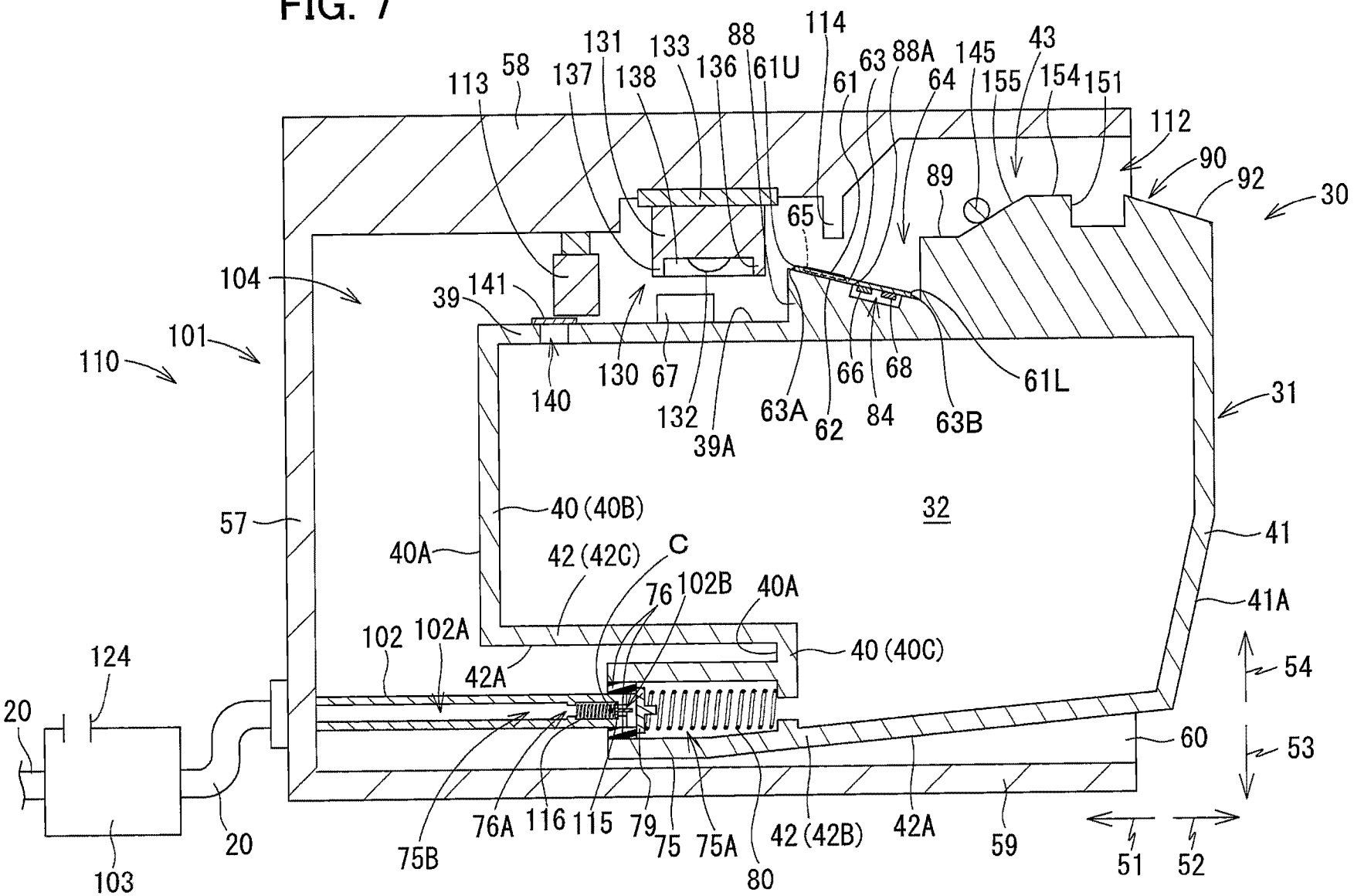
FIG. 7 is a vertical cross-sectional view of the ink cartridge according to the embodiment being inserted into the cartridge-attachment section.

In order to attach the ink cartridge 30 to the cartridge-attachment portion 110, the ink cartridge 30 is inserted forward into the cartridge holder 101 through the opening 112 of the cartridge-attachment portion 110 (see FIG. 7). Note that while the ink cartridge 30 is inserted into the cartridge holder 101 in a state similar to the upright posture in the embodiment, the ink cartridge 30 may instead be inserted into the cartridge holder 101 while tilted relative to the horizontal direction. As shown in FIG. 4, the upper portion 41U of the rear wall 41 is positioned farther rearward than the lower portion 41L. That is, the upper portion 41U is closer to the user than the lower portion 41L is. Hence, the user pushes forward on the upper portion 41U when inserting the ink cartridge 30 into the cartridge holder 101.

As the ink cartridge 30 is inserted forward into the cartridge holder 101, as illustrated in FIG. 7, the tube 102 of the cartridge-attachment portion 110 is inserted into the passage 75A of the cylinder 75 through the through-hole 76A formed in the sealing member 76 (the opening 75B). At this time, the outer circumferential surface of the tube 102 closely contacts an inner circumferential surface of the sealing member 76 (the surface defining the through-hole 76A). This configuration not only fixes the position of the cylinder 75 when the ink cartridge 30 is in its attached state, but also forms a liquid-tight seal between the cylinder 75 and tube 102 that prevents ink from leaking into the cartridge holder 101.

The tube 102 inserted into the passage 75A also contacts and pushes the valve 79 rearward. Through this action, the valve 79 is separated from the sealing member 76 against a forward urging force of the coil spring 80.

Further, when the distal end of the tube 102 contacts the valve 79, the valve 79 contacts the valve 115 from the rear side thereof and pushes the valve 115 forward. Consequently, the valve 115 moves forward against the urging force of the coil spring 116. This action allows the interior space 102A of the tube 102 to communicate with the exterior of the tube 102 through the opening 102B.

As a result, ink stored in the storage chamber 32 can flow into the tank 103 and recording head 21 via the interior space 102A of the tube 102. At this time (in the state shown in FIG. 7), the circuit board 64 is not yet in contact with the cartridge-attachment portion 110.

Also, when the ink cartridge 30 is being inserted forward into the cartridge holder 101, as illustrated in FIG. 7, the sloped surface 155 formed on the protruding part 43 of the ink cartridge 30 contacts the shaft 145 from the rear. The shaft 145 is guided along the sloped surface 155. As the user pushes the upper portion 41U of the rear wall 41 forward, torque (rotational moment) is applied to the ink cartridge 30 in a counterclockwise direction of FIG. 7. However, due to the contact between the sloped surface 155 and shaft 145, the ink cartridge 30 pivots clockwise in FIG. 7 against this torque about a center C of the opening 75B in which the tube 102 is inserted. The position of the center C in the ink cartridge 30 depends on the shape of the tube 102 and the shape of the opening 75B, but a center of an area at which the outer surface of the tube 102 contacts the inner circumferential surface of the sealing member 76 (the surface defining the through-hole 76A) is a hypothetical pivot center. The posture of the ink cartridge 30 at this point (the orientation of the ink cartridge 30 shown in FIG. 8) will be called a pivoted posture.

Forming the bottom wall 42 of the housing 31 as a sloped surface that slopes relative to the front-rear direction provides a space between the bottom wall 42 and an inner top surface of the bottom wall 59 of the cartridge holder 101 needed for this pivotal movement (clockwise pivot).

Figure 8:
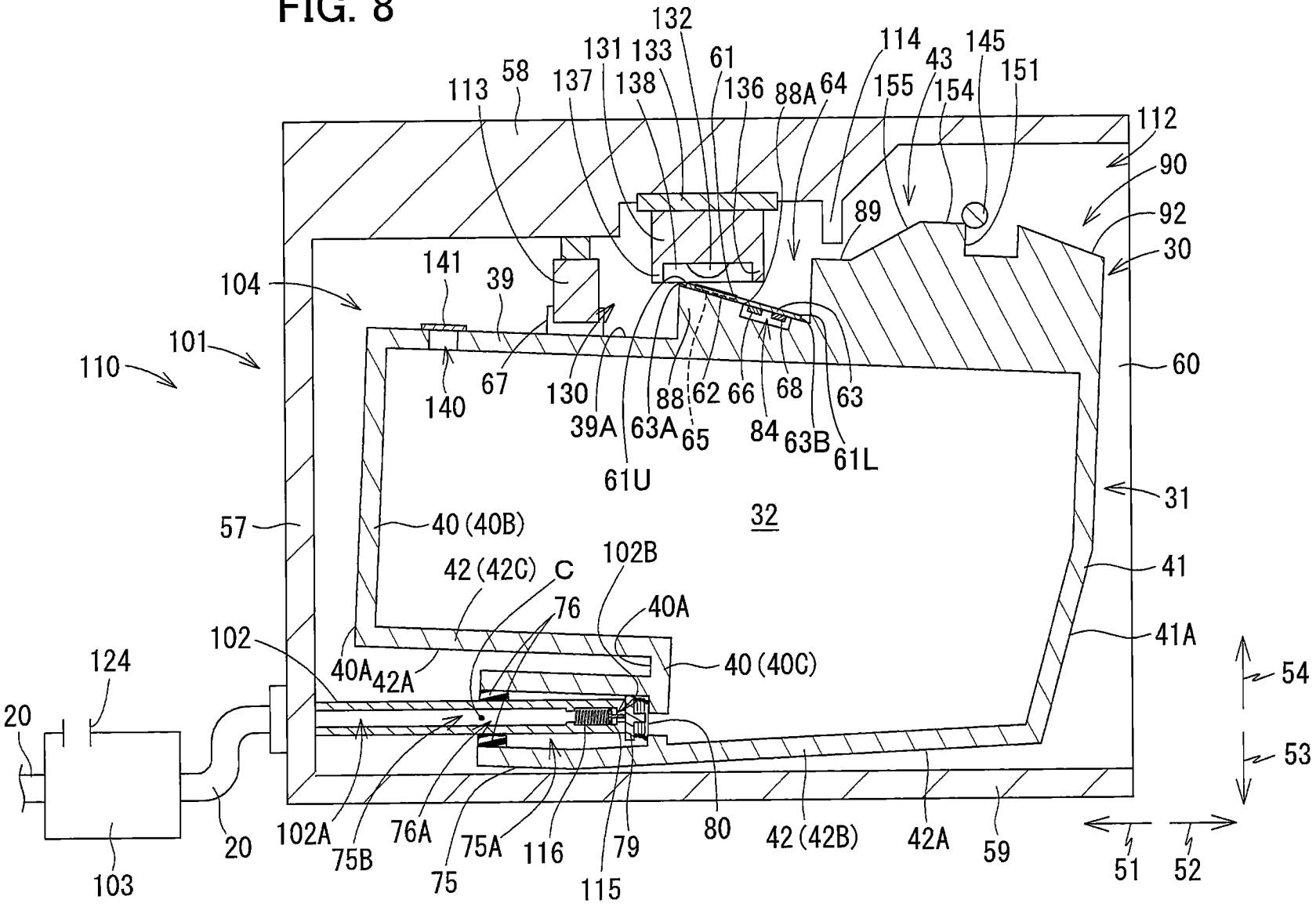
FIG. 8 is a vertical cross-sectional view of the ink cartridge according to the embodiment being inserted into the cartridge-attachment section, the ink cartridge being in a pivoted posture.

As the ink cartridge 30 is inserted farther forward from the state shown in FIG. 7 against the rearward urging force of the coil spring 80, the circuit board 64 arrives at a position beneath the contacts 132 (see FIG. 8). Owing to the pivoting described above, the ink cartridge 30 is tilted such that the circuit board 64 moves below the rear wall 136 of the connector 130, allowing the circuit board 64 to pass forward under the rear wall 136 of the connector 130 until arriving directly below the contacts 132. Also owing to the above pivoting, a vertical gap exists between the electrodes 65 on the circuit board 64 and the contacts 132 when the ink cartridge 30 is in the pivoted posture. In other words, the electrodes 65 are separated from the contacts 132. In addition, the positioning surface 89 arrives below the protruding part 114, but a vertical gap exists between the protruding part 114 and positioning surface 89 while the ink cartridge 30 is in its pivoted posture. In other words, the protruding part 114 is separated from the positioning surface 89.

Further, in the state depicted in FIG. 8, the sloped surface 155 and horizontal surface 154 of the protruding part 43 move to a position farther forward than the shaft 145. When the ink cartridge 30 is in this pivoted posture, the lock surface 151 is below the shaft 145.

As the user continues to push forward on the upper portion 41U of the rear wall 41, torque is applied to the ink cartridge 30 in the counterclockwise direction of FIG. 8. Since the sloped surface 155 and horizontal surface 154 no longer contact the shaft 145, the force applied by the user causes the ink cartridge 30 to pivot counterclockwise in FIG. 8 about the center C against the rearward urging force of the coil spring 80. As a result, the ink cartridge 30 assumes a state shown in FIG. 9, the state of the ink cartridge 30 at this time is the attached state. In the attached state, the cartridge holder 101 retains the ink cartridge 30 in the interior space 104 in the upright posture.

Next, states of components in the ink cartridge 30 and cartridge-attachment portion 110 while the ink cartridge 30 is in the attached state shown in FIG. 9 will be described.

As shown in FIG. 9, the tube 102 of the cartridge-attachment portion 110 has advanced into the passage 75A of the cylinder 75.

By pivoting the ink cartridge 30 shown in FIG. 8 counterclockwise, the positioning surface 89 of the ink cartridge 30 contacts the bottom surface of the protruding part 114 in the cartridge-attachment portion 110 from below. This contact restricts further upward movement of the ink cartridge 30, i.e., restricts the ink cartridge 30 from pivoting farther counterclockwise about the center C. Thus, the ink cartridge 30 is vertically positioned in the cartridge holder 101.

Further, by pivoting the ink cartridge 30 depicted in FIG. 8 counterclockwise, the protruding part 43 moves upward. Through this pivotal movement, the lock surface 151 of the ink cartridge 30 faces rearward and confronts the shaft 145 in the cartridge-attachment portion 110 in the front-rear direction. When the user stops pushing the ink cartridge 30 forward, the ink cartridge 30 is moved rearward by the urging force of the coil spring 80. However, since the rearward-facing lock surface 151 confronts the shaft 145, the lock surface 151 contacts the shaft 145 from the front side thereof as the ink cartridge 30 moves rearward (see FIG. 9). In other words, the lock surface 151 is in contact with the front side of the shaft 145 when the ink cartridge 30 is in the attached state. Hence, the protruding part 43 is engaged with the cartridge holder 101. This engagement restricts further rearward movement of the ink cartridge 30, thereby positioning the ink cartridge 30 in the front-rear direction in the cartridge holder 101.

As shown in FIG. 9, the projection 67 is positioned between the light-emitting part and light-receiving part of the optical sensor 113. Consequently, the projection 67 blocks the progression of light from the light-emitting part to the light-receiving part. That is, the projection 67 is positioned in the optical path of light irradiated from the light-emitting part when the ink cartridge 30 is in the attached state. In other words, the optical sensor 113 is positioned such that the light-blocking surface of the projection 67 is in the optical path of light irradiated from the light-emitting part when the ink cartridge 30 is in the attached state. At this time, the optical sensor 113 outputs a low level detection signal to the controller 1 (see FIG. 1).

Further, as a result of the pivoting of the ink cartridge 30 counterclockwise from the state shown in FIG. 8, the electrodes 65 of the circuit board 64 contact corresponding contacts 132 from below, thereby elastically deforming the contacts 132 upward (see FIG. 9). Thus, when the ink cartridge 30 is in the attached state, the electrodes 65 are electrically connected to the contacts 132 while elastically deforming the contacts 132 upward. With the four electrodes 65 contacting the corresponding contacts 132 so that electricity can be conducted therebetween, a voltage Vc is applied to the electrodes 65, the electrodes 65 are grounded, and power is supplied to the electrodes 65. Through this electrical connection between the contacts 132 and electrodes 65, the memory 66 mounted on the circuit board 64 is also electrically connected to the controller 1 (see FIG. 1). Consequently, the controller 1 can access the memory 66, enabling data stored in the memory 66 to be inputted into the controller 1 (see FIG. 1).

When the ink cartridge 30 is in the attached state shown in FIG. 8, the front wall 137 of the connector 130 is positioned frontward relative to the electrodes 65 on the circuit board 64 and the contacts 132 in the cartridge-attachment portion 110, and the rear wall 136 of the connector 130 is positioned rearward relative to the electrodes 65 and the contacts 132. Further, the bottom edge of the front wall 137 and the bottom edge of the rear wall 136 are positioned lower than the electrodes 65. With this arrangement, the electrodes 65 and contacts 132 are interposed between the rear wall 136 and front wall 137 in the front-rear direction when the ink cartridge 30 is in its attached state. That is, the front wall 137 and rear wall 136 enclose the electrodes 65 and contacts 132 from the front and rear sides thereof.

Further, a portion of the first surface 61 on the substrate 63 to the front side of the rear wall 136 (i.e., a front portion of the first surface 61) is higher than the bottom edge of the rear wall 136, while a portion of the first surface 61 rearward of the rear wall 136 (i.e., a rear portion of the first surface 61) is lower than the rear wall 136. As described above, the acute angle $\alpha$ formed between the first surface 61 and the virtual plane PL1 is greater than the acute angle $\beta$ formed between the virtual plane PL2 and the virtual plane PL1 (see FIG. 4). Accordingly, of the first surface 61 on the substrate 63, a portion that vertically overlaps the rear wall 136 when the ink cartridge 30 is in its attached state (when the electrodes 65 are in contact with the contacts 132) is lower than the bottom edge of the rear wall 136 and does not contact the rear wall 136. In other words, while the first surface 61 of the substrate 63 and the rear wall 136 face each other vertically when the ink cartridge 30 is in the attached state, a gap is formed between the first surface 61 and the rear wall 136.

As shown in FIG. 3B, when the ink cartridge 30 is in the attached state, the right wall 138 of the connector 130 is on the right side of the electrodes 65 and contacts 132 while the left wall 139 of the connector 130 is on the left side of the electrodes 65 and contacts 132. Further, the bottom edges of the right wall 138 and left wall 139 are positioned lower than the electrodes 65 and contacts 132 when the ink cartridge 30 is in its attached state. With this configuration, the electrodes 65 and contacts 132 are interposed between the right wall 138 and left wall 139 in the left-right direction when the ink cartridge 30 is in its attached state. That is, the right wall 138 and left wall 139 enclose the electrodes 65 and contacts 132 from the left and right sides thereof.

To extract the ink cartridge 30 from the cartridge holder 101 of the cartridge-attachment portion 110, the user pushes the operating surface 92 downward. As shown in FIG. 9, the operating surface 92 faces obliquely upward and rearward when the ink cartridge 30 is in the attached state. Hence, by operating the operating surface 92, the user applies force to the ink cartridge 30 in a direction diagonally downward and forward. This force pivots the ink cartridge 30 clockwise in FIG. 9, causing the positioning surface 89 to separate from the protruding part 114, as illustrated in FIG. 8. Further, the lock surface 151 is moved to a position lower than the shaft 145. In other words, the posture of the ink cartridge 30 is changed from the upright posture to the pivoted posture. Consequently, the urging force of the coil spring 80 moves the ink cartridge 30 rearward relative to the cartridge holder 101. Through the above operation, the user can then remove the ink cartridge 30 from the cartridge-attachment portion 110.

<Detecting Attachment of the Ink Cartridge 30 to the Cartridge-Attachment Portion 110>

Next, operations for detecting when an ink cartridge 30 is inserted into the cartridge-attachment portion 110 will be described with reference to flowcharts shown in FIGS. 10 and 11.

Figure 10:
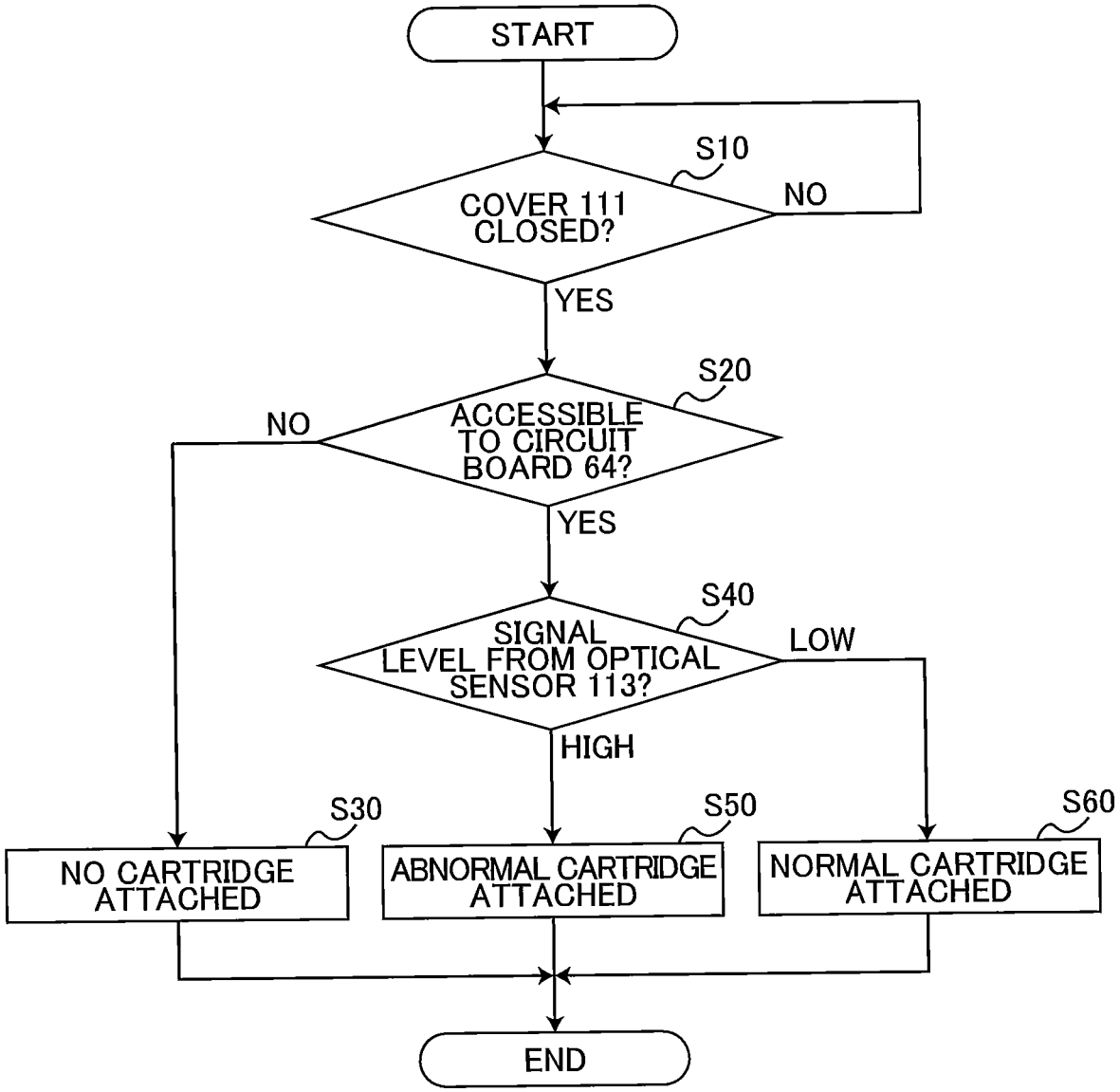
FIG. 10 is a flowchart illustrating steps to determine whether the ink cartridge according to the embodiment is attached to the cartridge-attachment section.
Figure 11:
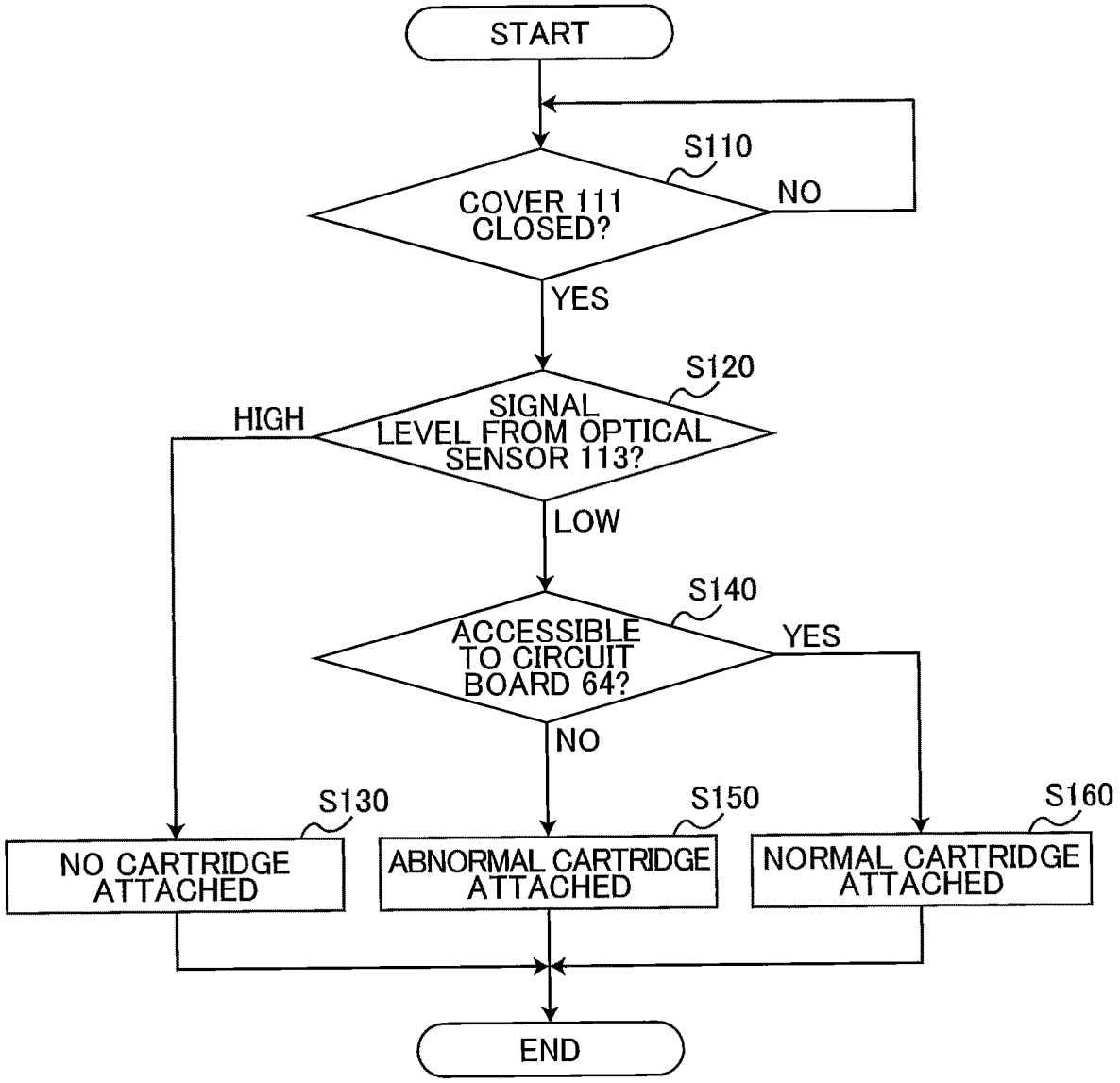
FIG. 11 is a flowchart illustrating another way of determining whether the ink cartridge according to the embodiment is attached to the cartridge-attachment section.

The flowcharts of FIGS. 10 and 11 are configured to be initiated when the cover 111 is opened by the user. That is, the controller 1 is configured to launch the flowchart of FIG. 10 or the flowchart of FIG. 11 in response to receiving a high level signal outputted from the cover sensor 118.

As shown in FIG. 10, in S10 the controller 1 (see FIG. 1) determines whether the cover 111 is in the closed position. The controller 1 determines that the cover 111 is in the closed position when the signal outputted from the cover sensor 118 changes to a low level signal.

In a case where the cover 111 is not in the closed position (S10: NO), the controller 1 repeats the determination in S10 until the cover 111 is determined to be closed, i.e., until the signal outputted from the cover sensor 118 changes from high level to low level.

When the cover 111 is determined to be in the closed position (S10: YES), in S20 the controller 1 determines whether the memory 66 on the circuit board 64 of the ink cartridge 30 is accessible, i.e., whether the controller 1 can read from or write to the memory 66. When the contacts 132 are in contact with and electrically connected to the electrodes 65 on the circuit board 64, the controller 1 is able to access the memory 66 on the circuit board 64. When the contacts 132 are not in contact with the electrodes 65 on the circuit board 64, the controller 1 cannot access the memory 66.

If the controller 1 cannot access the memory 66 (S20: NO), in S30 the controller 1 determines that an ink cartridge 30 is not mounted in the cartridge-attachment portion 110. In this case, the controller 1 notifies the user that an ink cartridge 30 is not mounted by displaying a message on a display panel (not shown) provided on a housing of the printer 10 and/or emitting a beep or other sound from a speaker (not shown).

However, when the controller 1 can access the circuit board 64 (S20: YES), in S40 the controller 1 determines whether the signal outputted from the optical sensor 113 to the controller 1 is high level or low level. When the projection 67 is positioned between the light-emitting part and light-receiving part of the optical sensor 113, the optical sensor 113 outputs a low level signal to the controller 1. When the projection 67 is not positioned between the light-emitting part and light-receiving part of the optical sensor 113, the optical sensor 113 outputs a high level signal to the controller 1.

When the signal outputted from the optical sensor 113 to the controller 1 is high level (S40: HIGH), in S50 the controller 1 determines that an abnormal ink cartridge 30 is attached to the cartridge-attachment portion 110. In this case, the controller 1 notifies the user that an abnormal ink cartridge 30 is mounted by displaying a message on the display panel (not shown) provided on the housing of the printer 10 and/or playing a beep or other sound from the speaker (not shown).

On the other hand, if the signal outputted by the optical sensor 113 is low level (S40: LOW), in S60 the controller 1 determines that a normal ink cartridge 30 is attached to the cartridge-attachment portion 110.

In the flowchart of FIG. 10, the controller 1 determines whether an ink cartridge 30 is mounted in the cartridge-attachment portion 110 based on whether the circuit board 64 is accessible, and determines whether the ink cartridge 30 mounted in the cartridge-attachment portion 110 is normal based on the level of the signal outputted from the optical sensor 113.

However, the controller 1 may be configured to determine whether an ink cartridge 30 is mounted in the cartridge-attachment portion 110 based on the level of the signal outputted from the optical sensor 113 and to determine whether the ink cartridge 30 mounted in the cartridge-attachment portion 110 is normal based on whether the circuit board 64 is accessible. Steps in this variation will be described next with reference to the flowchart in FIG. 11.

Referring to FIG. 11, the controller 1 first determines in S110 whether the cover 111 is in the closed position, as in the flowchart of FIG. 10. The controller 1 repeats the determination in S110 (S110: NO) until the cover 111 is determined to be in the closed position, i.e., until the signal outputted from the cover sensor 118 changes from high level to low level.

When the controller 1 determines in S110 that the cover 111 is in the closed position (S110: YES), in S120 the controller 1 determines whether the signal outputted from the optical sensor 113 to the controller 1 is high level or low level.

If the signal outputted by the optical sensor 113 is high level (S120: HIGH), in S130 the controller 1 determines that an ink cartridge 30 is not mounted in the cartridge-attachment portion 110. In this case, as in S30 of FIG. 10, the controller 1 notifies the user that an ink cartridge 30 is not mounted.

However, if the signal outputted by the optical sensor 113 is low level (S120: LOW), in S140 the controller 1 determines whether the circuit board 64 of the ink cartridge 30 is accessible.

If the controller 1 cannot access the circuit board 64 (S140: NO), in S150 the controller 1 determines that an abnormal ink cartridge 30 is mounted in the cartridge-attachment portion 110. In this case, as in S50 of FIG. 10, the controller 1 notifies the user that an abnormal ink cartridge 30 is mounted.

On the other hand, if the controller 1 can access the circuit board 64 (S140: YES), in S160 the controller 1 determines that a normal ink cartridge 30 is mounted in the cartridge-attachment portion 110.

Operational and Technical Advantages of the Embodiment

According to the described embodiment, the substrate 63 has the first surface 61 that slopes relative to the virtual plane PL1 to form the acute angle α therebetween that is greater than the acute angle β formed between the virtual plane PL2 and virtual plane PL1. Therefore, even when the front wall 137 and rear wall 136 are provided around the contacts 132 in the cartridge-attachment portion 110, the electrodes 65 can be brought into contact with the contacts 132 without the substrate 63 contacting the front wall 137 or rear wall 136.

Further, providing the substrate 63 with the first surface 61 that is sloped relative to the virtual plane PL1 can prevent the substrate 63 from contacting the front wall 137 and rear wall 136, even when the front-rear dimension of the substrate 63 is longer than the gap between the front wall 137 and rear wall 136 in the front-rear direction, as in the embodiment described above.

Since the front-rear dimension of the substrate 63 can be longer than the gap between the front wall 137 and rear wall 136 in the front-rear direction, i.e., since the dimensions of the substrate 63 can be increased, sufficient space can be allocated on the substrate 63 for forming the electrodes 65 and mounting the memory 66.

Further, since the substrate 63 includes the first surface 61 that slopes relative to the virtual plane PL1, foreign matter deposited on the first surface 61 is more likely to fall off the substrate 63.

Further, the electrodes 65 in the embodiment are formed at positions on the first surface 61 closer to the upper edge 61U (front end face 63A) than the lower edge 61L (rear end face 63B). Hence, the electrodes 65 are better positioned to contact the contacts 132.

The memory 66 is also positioned on the second surface 62 at a position lower than the electrodes 65 in the depicted embodiment. Hence, the memory 66 is unlikely to collide with the contacts 132. Further, even if a portion on the first surface 61 lower than the electrodes 65 may collide with the contacts 132 during the insertion of the ink cartridge 30 into the cartridge-attachment section 110, the memory 66 is less likely to be affected by impact of the collision.

When the electrodes 65 are in contact with the contacts 132, an upper portion of the substrate 63 (i.e., a portion closer to the front end face 63A than to the rear end face 63B) is positioned between the front wall 137 and rear wall 136 in the front-rear direction. Consequently, there is not enough room for mounting the battery 68 in the upper portion of the substrate 63. Hence, the battery 68 in the embodiment is mounted on a lower portion of the substrate 63 (i.e., a portion closer to the rear end face 63B than to the front end face 63A) where sufficient space can be allocated.

In the depicted embodiment, the battery 68 is positioned lower than the memory 66. This configuration can reduce the likelihood of the battery 68 colliding with the contacts 132 and causing deterioration in the functionality of the memory 66. Further, by arranging the electrodes 65, memory 66, and battery 68 as described in the embodiment, wiring for electrically connecting the electrodes 65 to the memory 66 and wiring for electrically connecting the battery 68 to the memory 66 can be run without interference more easily.

In the embodiment, the first surface 61 faces rearward, while the passage 75A in the cylinder 75 is open frontward. This arrangement can reduce a possibility that ink leaking out of the passage 75A could become deposited on the first surface 61.

In the embodiment, the left-right dimension of the substrate 63 is shorter than the gap between the right wall 138 and left wall 139 in the left-right direction. Accordingly, the electrodes 65 can be brought into contact with the contacts 132 positioned between the right wall 138 and left wall 139.

Since the electrodes 65 are formed to be aligned with each other at intervals in the left-right direction in the embodiment, a range over which the electrodes 65 are formed in the front-rear direction can be reduced. Further, elongating the electrodes 65 in the front-rear direction can reduce a potential that the electrodes 65 may lose contact with the contacts 132, even if the front-rear position of the ink cartridge 30 in the cartridge-attachment portion 110 varies when the ink cartridge 30 is mounted in the cartridge-attachment portion 110.

Since the memory 66 is mounted on the second surface 62 in the embodiment, collisions between the ink cartridge 30 and components in the cartridge-attachment portion 110 that may occur during the insertion of the ink cartridge 30 into the cartridge-attachment portion 110 can be prevented from directly impacting the memory 66.

In the depicted embodiment, the ink cartridge 30 is pivoted during the process of inserting the ink cartridge 30 into the cartridge holder 101. Accordingly, without adding a complex structure to the ink cartridge 30 and/or cartridge holder 101, the electrodes 65 can be moved to a position for contacting the contacts 132 while not coming into contact with the rear wall 136 during the process of inserting the ink cartridge 30 into the cartridge holder 101.

In the depicted embodiment, the cartridge-attachment portion 110 (precisely, the tube 102) contacts the rubber sealing member 76 prior to contacting the circuit board 64 during the process of attaching the ink cartridge 30 to the cartridge-attachment portion 110. This contact reduces a speed at which the ink cartridge 30 is inserted and can soften the force of impact with the circuit board 64.

<First Modification>

As illustrated in FIG. 4, the memory 66 and battery 68 are mounted on the second surface 62 of the substrate 63 in the depicted embodiment. The memory 66 is mounted at a position diagonally downward and rearward from the electrodes 65, and the battery 68 is mounted at a position diagonally downward and rearward from the memory 66. However, the mounting positions of the memory 66 and battery 68 are not limited to the positions shown in FIG. 4.

Figure 12A:
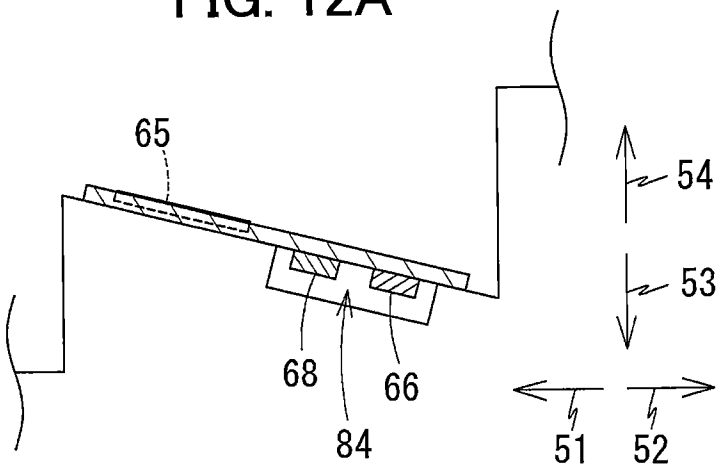
FIGS. 12A through 12D are partially-enlarged cross-sectional views illustrating various circuit boards of ink cartridges according to a first modification to the embodiment.
Figure 12B:
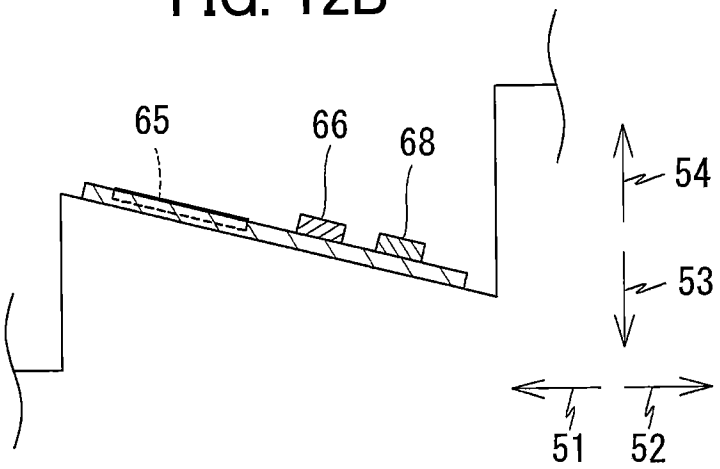
Figure 12C:
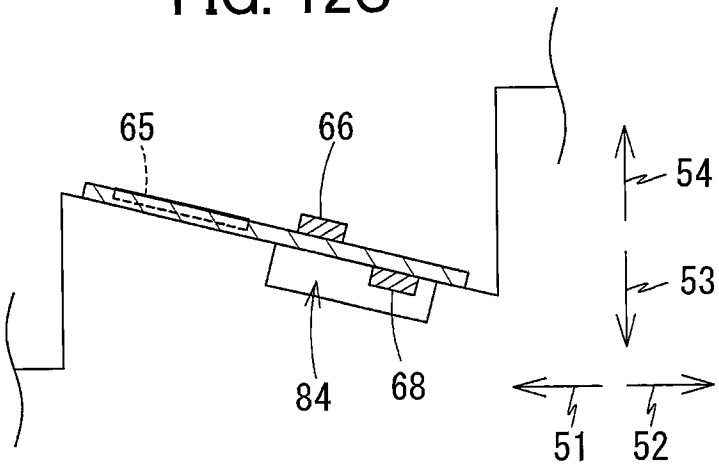

For example, as depicted in FIG. 12A, the battery 68 may be mounted on the second surface 62 at a position diagonally upward and forward of the memory 66. Alternatively, the memory 66 and battery 68 may be mounted on the first surface 61 of the substrate 63, rather than on the second surface 62 (see FIG. 12B), provided that the memory 66 and battery 68 are positioned lower than the electrodes 65. Still alternatively, as shown in FIG. 12C, the memory 66 may be mounted on the first surface 61 of the substrate 63 at a position lower than the electrodes 65, while the battery 68 is mounted on the second surface 62 of the substrate 63. Or, conversely, the battery 68 may be mounted on the first surface 61 at a lower position than electrodes 65, while the memory 66 is mounted on the second surface 62.

Figure 12D:
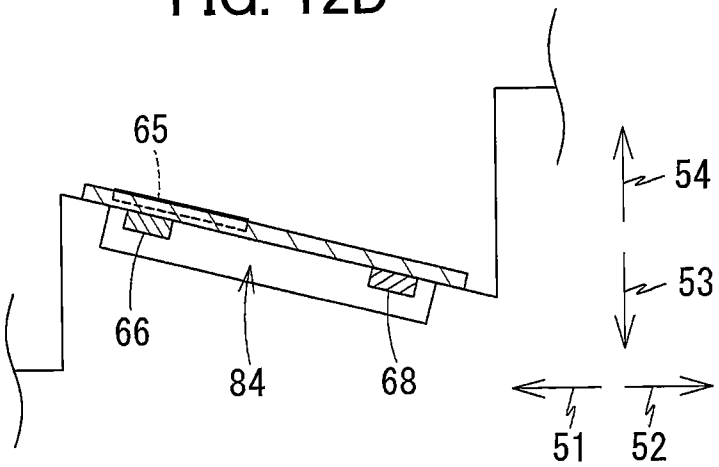

Still alternatively, at least one of the memory 66 and battery 68 may be mounted farther forward than rear edges of the electrodes 65 on the second surface 62. FIG. 12D shows an example configuration in which the memory 66 is mounted farther forward than the rear edges of the electrodes 65 while the battery 68 is mounted farther rearward than the rear edges of the electrodes 65.

<Second Modification>

In the embodiment described above, the front edge of the first surface 61 also constitutes the upper edge 61U of the first surface 61. However, the rear edge of the first surface 61 may be configured as the upper edge.

Figure 13:
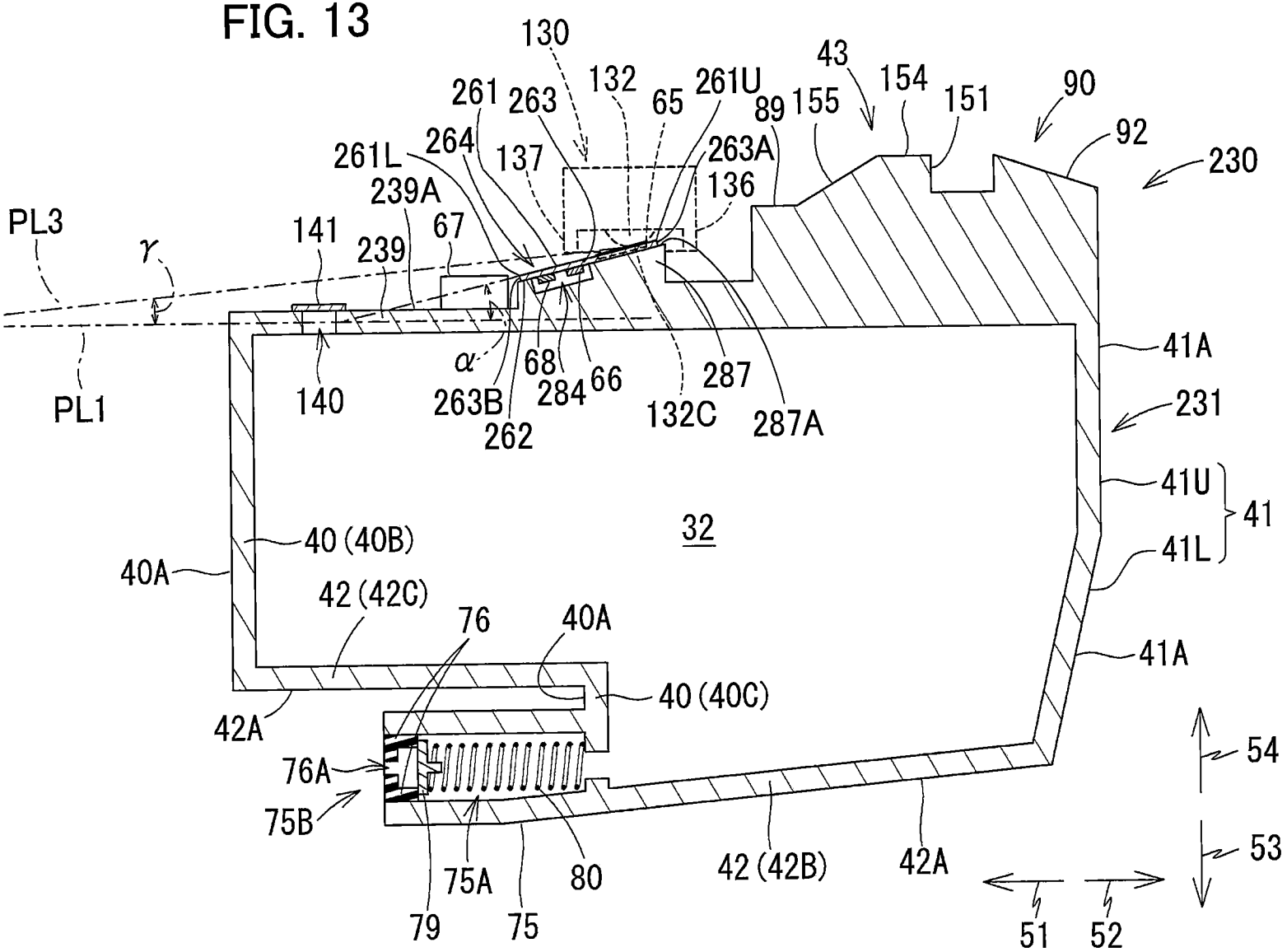
FIG. 13 is a vertical cross-sectional view of an ink cartridge according to a second modification to the embodiment.

FIG. 13 illustrates an ink cartridge 230 according to a second modification to the embodiment. The ink cartridge 230 includes a housing 231 and a circuit board 264. In this second modification, a protruding part 287 is provided on a top surface 239A of a top wall 239 of the housing 231, in place of the protruding part 88 of the embodiment. The protruding part 287 is positioned forward of the protruding part 43 and rearward of the projection 67 on the top surface 239A. A top edge of the protruding part 287 is lower than the top edge of the protruding part 43. The protruding part 287 has a top surface 287A that slopes relative to the virtual plane PL1, and more specifically that slopes upward toward the rear. The protruding part 287 is disposed farther forward than the protruding part 88 of the embodiment in the front-rear direction.

The circuit board 264 includes a substrate 263 that is supported from below by the top surface 287A of the protruding part 287.

As in the embodiment, the substrate 263 is bonded to the top surface 287A of the protruding part 287 with a photopolymer. Of course, as described in the embodiment, the substrate 263 may be mounted on the top surface 287A through means other than bonding with a photopolymer.

Since the top surface 287A of the protruding part 287 slopes upward toward the rear relative to the virtual plane PL1, both of a first surface 261 and a second surface 262 of the substrate 263 bonded to the top surface 287A slope upward toward the rear relative to the virtual plane PL1. Hence, the rear edge of the first surface 261 is an upper edge 261U of the first surface 261, while the front edge of the first surface 261 is a lower edge 261L of the first surface 261. In other words, the upper edge 261U is positioned rearward relative to the lower edge 261L. Through this configuration, the protruding part 287 maintains the first surface 261 of the substrate 263 at the desired angle of inclination, i.e., the acute angle $\alpha$, relative to the virtual plane PL1.

The acute angle $\alpha$ formed by the first surface 261 and the virtual plane PL1 is greater than an acute angle $\gamma$ formed by a virtual plane PL3 and the virtual plane PL1. The virtual plane PL3 is a plane that extends in the left-right direction and passes through the portions 132C of the contacts 132 and the bottom edge of the front wall 137.

The memory 66 and battery 68 are mounted on the second surface 262 of the substrate 263. A depression 285 is formed in the top surface 287A of the protruding part 287 at an area corresponding to the region in which the memory 66 and battery 68 are mounted. In other words, the memory 66 and battery 68 mounted on the second surface 262 are accommodated in the depression 285.

The electrodes 65 are formed on the first surface 261 at positions closer to the upper edge 261U thereof than the lower edge 261L. The memory 66 and battery 68 are mounted on the second surface 262 at positions closer to a lower end face 263B of the substrate 263 than a top end face 263A of the substrate 263. Further, the memory 66 and battery 68 are mounted diagonally downward and forward from the electrodes 65, and the battery 68 is mounted diagonally downward and forward from the memory 66. Note that the memory 66 and battery 68 may be mounted in various other positions, as described in the first modification.

The motion of the circuit board 264 when the ink cartridge 230 is inserted into the cartridge holder 101 is identical to that described in the embodiment. That is, when the user inserts the ink cartridge 230 forward into the interior space 104 of the cartridge holder 101 while pivoting the ink cartridge 230, the circuit board 264 moves forward while passing beneath the rear wall 136 of the connector 130 until arriving at a position directly beneath the contacts 132. Subsequently, as the ink cartridge 230 is pivoted in the opposite direction from the above pivotal movement, the electrodes 65 of the circuit board 264 contact the contacts 132 from below.

When the ink cartridge 230 is in its attached state, the rear wall 136 of the connector 130 is positioned farther rearward than the electrodes 65 of the circuit board 264 and the contacts 132 in the cartridge-attachment portion 110, and the front wall 137 of the connector 130 is positioned farther forward than the electrodes 65 and contacts 132. In addition, the bottom edges of the front wall 137 and rear wall 136 are lower than the electrodes 65.

A portion of the first surface 261 on the substrate 263 to the rear of the front wall 137 (a rear portion) is positioned higher than the bottom edge of the front wall 137. A portion of the first surface 261 that is forward of the front wall 137 is positioned lower than the front wall 137. As described above, the acute angle α formed by the first surface 261 and the virtual plane PL1 is greater than the acute angle γ formed by the virtual plane PL3 and the virtual plane PL1. Accordingly, when the ink cartridge 230 is in its attached state (when the electrodes 65 are in contact with the contacts 132), the portion of the first surface 261 on the substrate 263 that vertically overlaps the front wall 137 is positioned lower than the bottom edge of the front wall 137 and is not in contact with the front wall 137. In other words, when the ink cartridge 230 is in its attached state, the first surface 261 of the substrate 263 vertically opposes the front wall 137 with a gap formed therebetween.

Also when the ink cartridge 230 is in its attached state, the right wall 138 and left wall 139 of the connector 130 enclose the electrodes 65 and contacts 132 from right and left sides, as in the embodiment described above.

Note that, in this structure of the second modification, the acute angle α may not necessarily be greater than the acute angle β formed by the virtual plane PL2 and virtual plane PL1, provided that the acute angle α formed by the first surface 261 and the virtual plane PL1 is greater than the acute angle γ formed by the virtual plane PL3 and the virtual plane PL1.

According to the second modification, the rear edge of the first surface 261 serves as the upper edge 261U. This configuration can reduce the potential for collision between the portion of the first surface 61 positioned forward of the rear edge and the contacts 132.

<Third Modification>

The substrate 63 is supported on the protruding part 88 in the embodiment, and the substrate 263 is supported on the protruding part 287 in the second modification. However, the means for supporting the substrate 63, 263 is not limited to a single sloped surface on a support portion (such as the protruding part 88, 287), provided that the substrate is supported such that a first surface thereof (upper surface) slopes relative to the virtual plane PL1 with the acute angle α formed therebetween.

Figure 14:
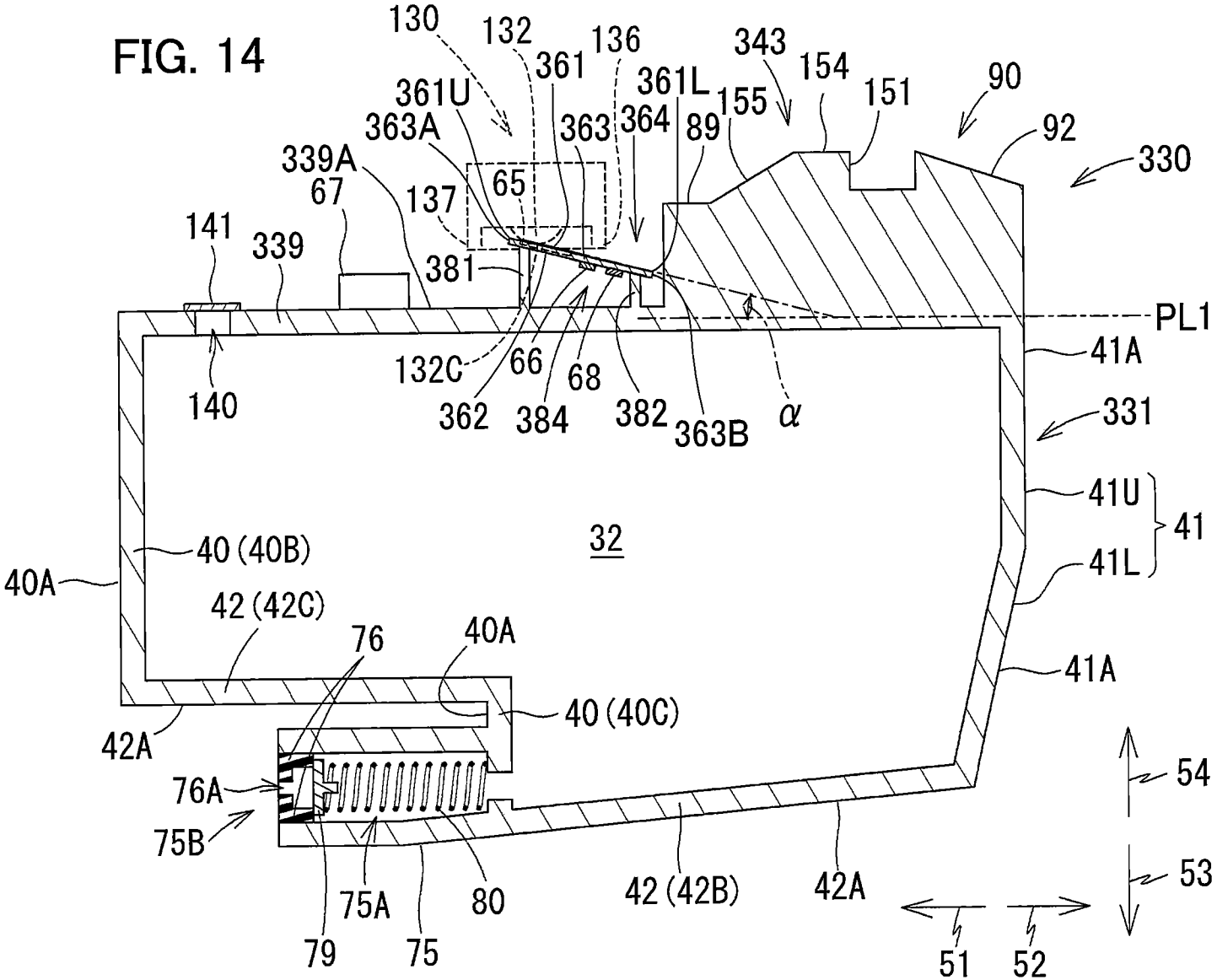
FIG. 14 is a vertical cross-sectional view of an ink cartridge according to a third modification to the embodiment.

For example, FIG. 14 illustrates an ink cartridge 330 according to a third modification to the embodiment including a housing 331 and a circuit board 364. In this ink cartridge 330, two protruding parts 381 and 382 are provided on a top surface 339A of a top wall 339 of the housing 331, instead of the protruding part 88, for supporting a substrate 363 of the circuit board 364. The two protruding parts 381 and 382 have different protruding lengths from the top surface 339A of the top wall 339. The protruding parts 381 and 382 are aligned with each other in the front-rear direction to form a gap 384 therebetween on the top surface 339A. The substrate 363 is supported at front and rear ends thereof by the protruding parts 381 and 382, respectively. With this structure, a first surface 361 (top surface) of the substrate 363 is maintained to be inclined relative to the virtual plane PL1 with the acute angle α formed between the first surface 361 and the virtual plane PL1.

The electrodes 65 are formed on the first surface 361 of the substrate 363 at positions closer to an upper edge 361U of the first surface 361 than to the lower edge 361L of the first surface 361, as in the embodiment. The memory 66 and battery 68 are mounted on a second surface 362 (lower surface) of the substrate 363. The memory 66 and battery 68 mounted on the second surface 362 are accommodated in the gap 384 in a state where the substrate 363 is supported by the protruding parts 381 and 382. Hence, the memory 66 and battery 68 are lower than the electrodes 65, as in the embodiment.

<Fourth Modification>

Figure 15:
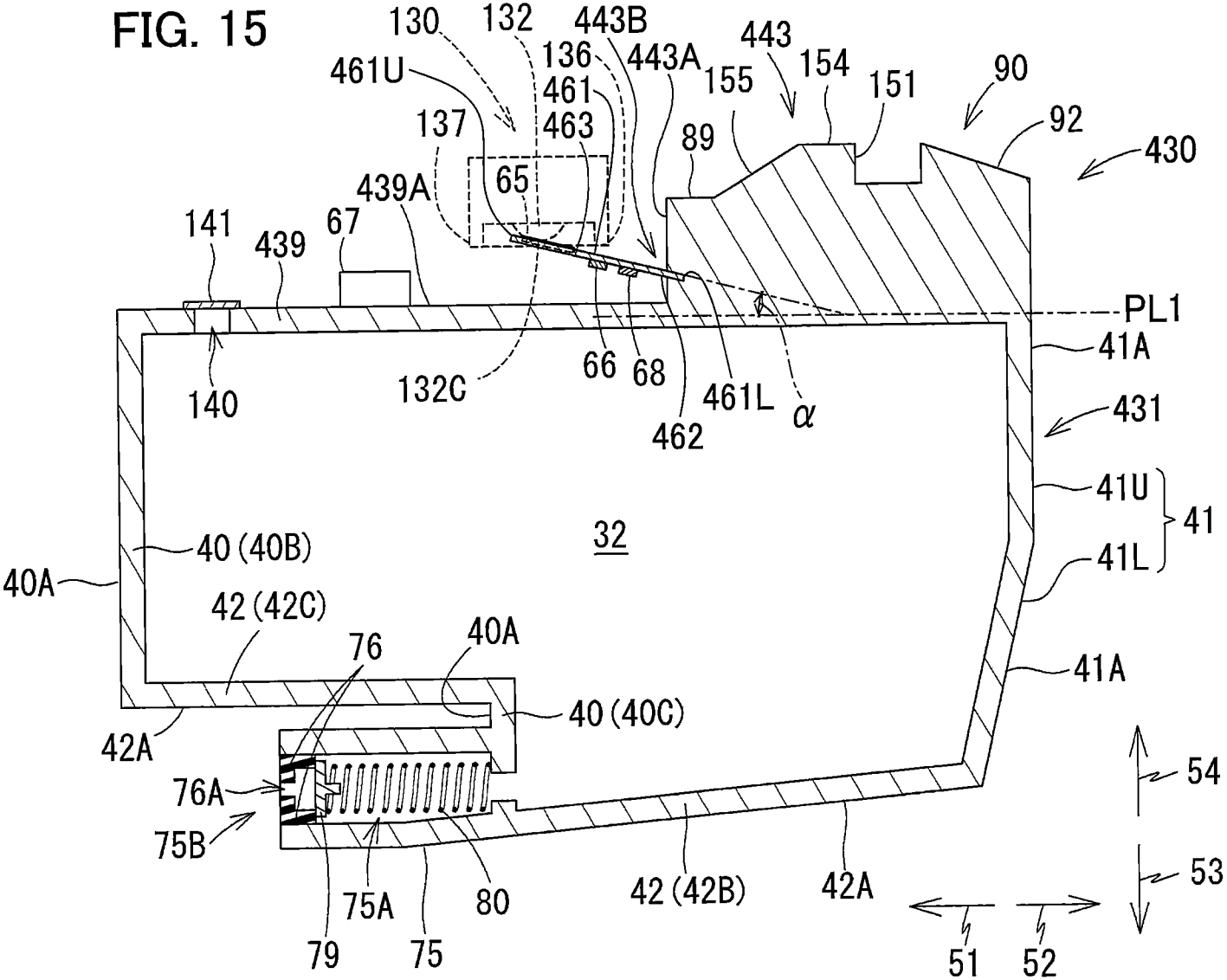
FIG. 15 is a vertical cross-sectional view of an ink cartridge according to a fourth modification.

FIG. 15 depicts an ink cartridge 430 according to a fourth modification to the embodiment provided with still another example of the support portion in place of the protruding part 88 in the embodiment. The ink cartridge 430 includes a housing 431 and a circuit board 464. Instead of the protruding part 43 of the embodiment, the housing 431 includes a protruding part 443 formed on a top surface 439A of a top wall 439. A recessed part 443B is formed in a front surface 443A of the protruding part 443 for supporting a substrate 463 of the circuit board 464. Specifically, a rear end portion of the substrate 463 is fitted into the recessed part 443B so that the substrate 463 protrudes diagonally upward and forward from the front surface 443A of the protruding part 443. With this structure, a first surface 461 of the substrate 463 slopes relative to the virtual plane PL1 with the acute angle α formed therebetween.

The electrodes 65 are formed on the first surface 461 at a position closer to an upper edge 461U of the first surface 461 than to a lower edge 461L of the first surface 461. The memory 66 and battery 68 are mounted on a second surface 462 of the substrate 463 that is fixed above the top surface 439A.

<Fifth Modification>

In the embodiment, the top surface 88A of the protruding part 88 slopes relative to the virtual plane PL1, whereby the first surface 61 and second surface 62 of the substrate 63 supported by the top surface 88A also slope relative to the virtual plane PL1. However, as long as the first surface 61 slopes relative to the virtual plane PL1, it is not absolutely necessary for the second surface 62 to slope relative to the virtual plane PL1.

Figure 16:
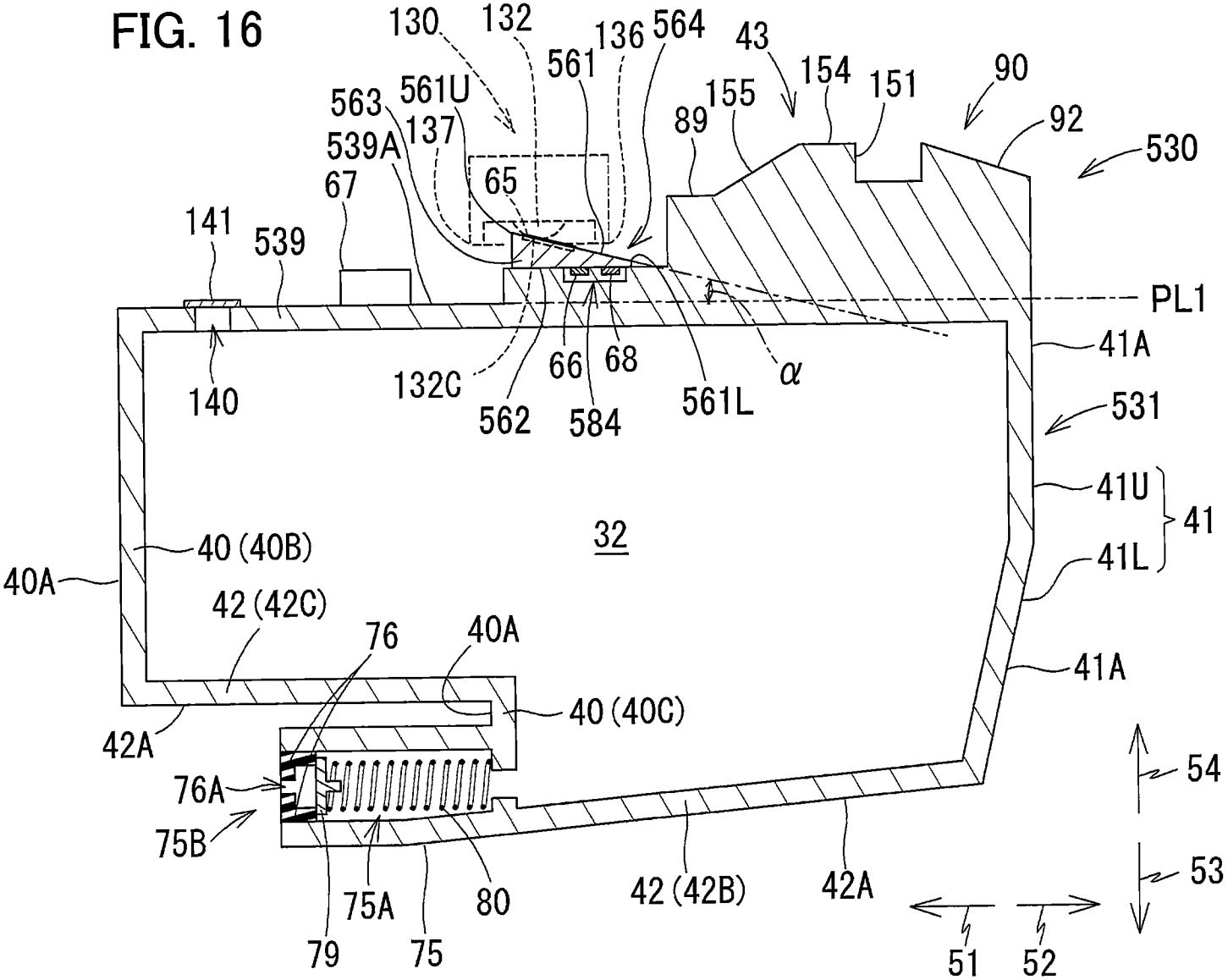
FIG. 16 is a vertical cross-sectional view of an ink cartridge according to a fifth modification to the embodiment.

FIG. 16 shows an ink cartridge 530 according to a fifth modification to the embodiment. The ink cartridge 530 includes a housing 531 and a circuit board 564. The circuit board 564 includes a substrate 563 having a generally triangular shape in a vertical cross-sectional view. That is, in this substrate 563, a first surface 561 slopes relative to the virtual plane PL1 to form the acute angle α therebetween, while a second surface 562 extends parallel to the virtual plane PL1. Put another way, the substrate 563 has a thickness in the vertical direction that becomes smaller toward a lower edge 561L of the first surface 561. Or, the thickness (vertical dimension) of the substrate 563 is smaller at the lower edge 561L than at an upper edge 561U of the first surface 561.

The substrate 563 is supported directly by a top wall 539 of the housing 531 with the second surface 562 bonded to a top surface 539A of the top wall 539. That is, the top wall 539 does not include the support portion for supporting the substrate 563 in order to maintain the inclination of the first surface 561 relative to the virtual plane PL1.

The electrodes 65 are formed on the sloped first surface 561 at positions closer to the upper edge 561U thereof than to the lower edge 561L thereof. The memory 66 and electrodes 65 are mounted on the horizontal second surface 562. A depression 584 is formed on the top surface 539A of the top wall 539 in an area corresponding to the region in which the memory 66 and battery 68 are mounted. That is, the memory 66 and battery 68 mounted on the second surface 562 of the substrate 563 are accommodated in the depression 584.

<Sixth Modification>

Figure 17:
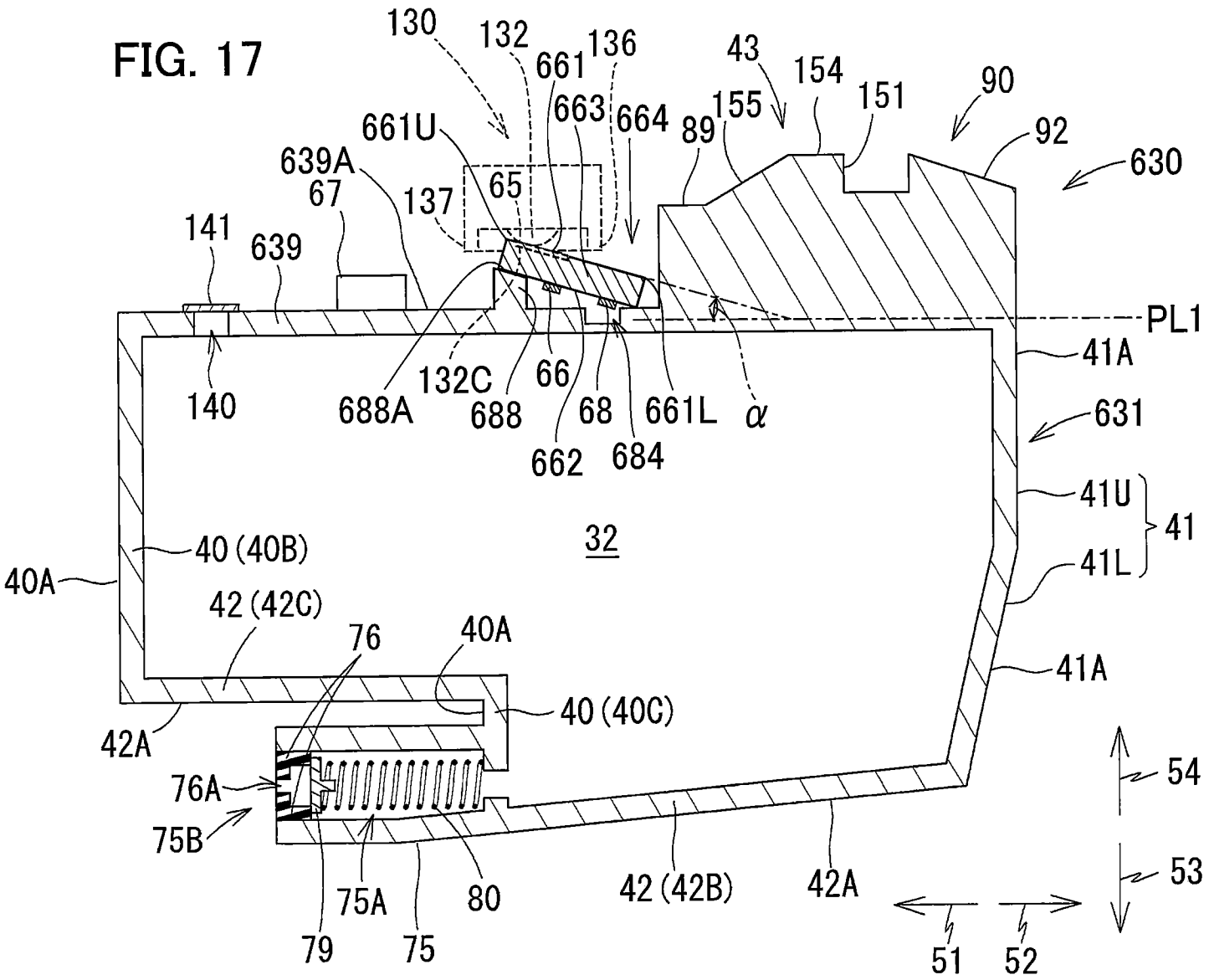
FIG. 17 is a vertical cross-sectional view of an ink cartridge according to a sixth modification to the embodiment.

FIG. 17 depicts an ink cartridge 630 according to a sixth modification to the embodiment. The ink cartridge 630 includes a housing 631 and a circuit board 664. The circuit board 664 is supported on a top wall 639 of the housing 631. The circuit board 664 includes a rigid substrate 663 having a thickness greater than a thickness of the substrate 63 of the embodiment with respect to the vertical direction.

The substrate 663 has a first surface 661 and a second surface 662. The first surface 661 is sloped relative to the virtual plane PL1 to form the acute angle α therebetween, as in the embodiment. A protruding part 688 is formed on a top surface 639A of the top wall 639 to support the substrate 663. The protruding part 688 has a sloped top surface 688A for supporting the second surface 662 of the substrate 663.

Specifically, the substrate 663 is supported on the top surface 639A of the top wall 639 such that: a front end portion of the second surface 662 is fixed to the sloped top surface 688A of the protruding part 688; and a rear edge of the second surface 662 is in contact with the top surface 639A of the top wall 639. With this structure, the inclination of the first surface 661 relative to the virtual plane PL1 can be maintained.

In the circuit board 664, the electrodes 65 are formed on the first surface 661 at positions closer to an upper edge 661U thereof than to a lower edge 661L thereof, as in the depicted embodiment. The memory 66 and battery 68 are mounted on the second surface 662. The memory 66 is positioned closer to the protruding part 688 than the battery 68 is to the protruding part 688 in the front-rear direction. Hence, due to the inclination of the second surface 662 relative to the virtual plane PL1 (i.e., relative to the top surface 639A), the memory 66 mounted on the second surface 662 is positioned above the top surface 639A of the top wall 639. Further, a depression 684 is formed in the top wall 639 so that the battery 68 mounted on the second surface 662 can be received in the depression 684.

Note that the battery 68 may not be mounted on the second surface 862. In this case, the depression 684 is not necessary to be formed in the top surface 639A of the top wall 639.

Still alternatively, in a case that the protruding part 688 is shaped such that the top surface 688A supports an entirety of the second surface 662 as in the embodiment, the depression 684 may be formed in the top surface 688A to accommodate both of the memory 66 and battery 68, just as the depression 84 of the embodiment.

<Seventh Modification>

The substrate 63 of the depicted embodiment is a rigid substrate. However, the substrate 63 may be a flexible substrate formed of a plastic film or the like.

Figure 18:
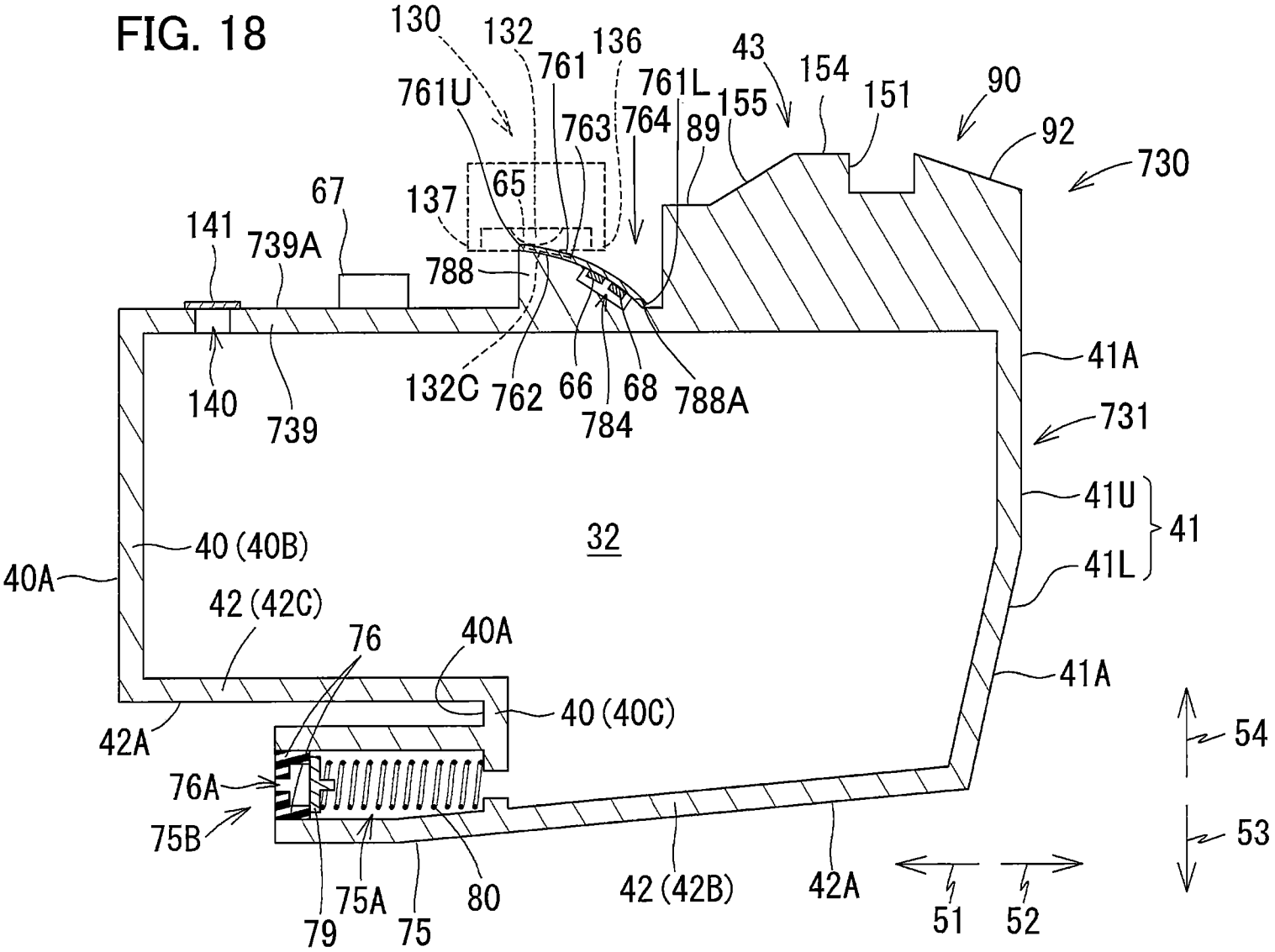
FIG. 18 is a vertical cross-sectional view of an ink cartridge according to a seventh modification to the embodiment.

FIG. 18 depicts an ink cartridge 730 according to a seventh modification to the embodiment. The ink cartridge 730 includes a housing 731 and a circuit board 764. The circuit board 764 includes a flexible substrate 763. The substrate 763 has a curved shape in a vertical cross-sectional view, contrary to the rigid, flat plate-shaped substrate 63 of the embodiment.

A protruding part 788 is formed on a top surface 739A of a top wall 739 of the housing 731. The protruding part 788 has a top surface 788A that is curved upward to form a generally convex shape in a vertical cross-sectional view. The flexible substrate 763 is fixed to the curved top surface 788A to extend therealong, so that the substrate 763 has a curved first surface 761 and a second surface 762. That is, the second surface 762 of the substrate 763 is bonded to the top surface 788A of the protruding part 788.

The electrodes 65 are formed on the first surface 761 at positions closer to an upper edge 761U thereof, in order to allow the electrodes 65 to contact the contacts 132 of the connector 130 while the ink cartridge 730 is attached to the cartridge holder 101 of the cartridge-attachment section 110. The memory 66 and battery 68 are mounted on the curved second surface 762 of the substrate 763. A depression 784 is formed on the curved top surface 788A in an area corresponding to the region in which the memory 66 and battery 68 are mounted. That is, the memory 66 and battery 68 mounted on the second surface 762 of the substrate 763 are accommodated in the depression 784.

<Other Variations>

In the embodiment and the modifications described above, communication between the passage 75A and the outside of the cylinder 75 is switched on and off with the valve 79. However, the opening 75B may be sealed with a seal rather than the valve 79. Specifically, the seal is affixed to the front surface of the cylinder 75 before the ink cartridge 30 is inserted into the cartridge-attachment portion 110, thereby sealing off the through-hole 76A from the outside. Hence, ink in the storage chamber 32 does not flow through the passage 75A and out of the ink cartridge 30 through the through-hole 76A. When the ink cartridge 30 is inserted into the cartridge-attachment portion 110, the tube 102 punctures the seal, breaking the hermetic seal.

In the embodiment described above, the ink cartridge 30 is pivoted inside the cartridge holder 101 while being inserted therein. However, the ink cartridge 30 need not be pivoted or tilted inside the cartridge holder 101 during the insertion process. For example, the ink cartridge 30 may be inserted into the cartridge holder 101 in a direction diagonally frontward and upward, without being pivoted.

Further, in the embodiment described above, the ink cartridge 30 is fixed in position in the front-rear direction by the lock surface 151 contacting the shaft 145 from the front side thereof. However, the positioning means for the ink cartridge 30 is not limited to this contact between the lock surface 151 and shaft 145. For example, the ink cartridge 30 may be fixed in the front-rear direction through sliding resistance between the positioning surface 89 of the ink cartridge 30 and the bottom surface on the protruding part 114 of the cartridge-attachment portion 110, and sliding resistance between the bottom surface 42A of the ink cartridge 30 and the inner top surface on the bottom wall 59 of the cartridge-attachment portion 110. Alternatively, the ink cartridge 30 may be fixed in the front-rear direction through sliding resistance between the sealing member 76 of the ink cartridge 30 and the tube 102 of the cartridge-attachment portion 110, for example.

Figure 19:
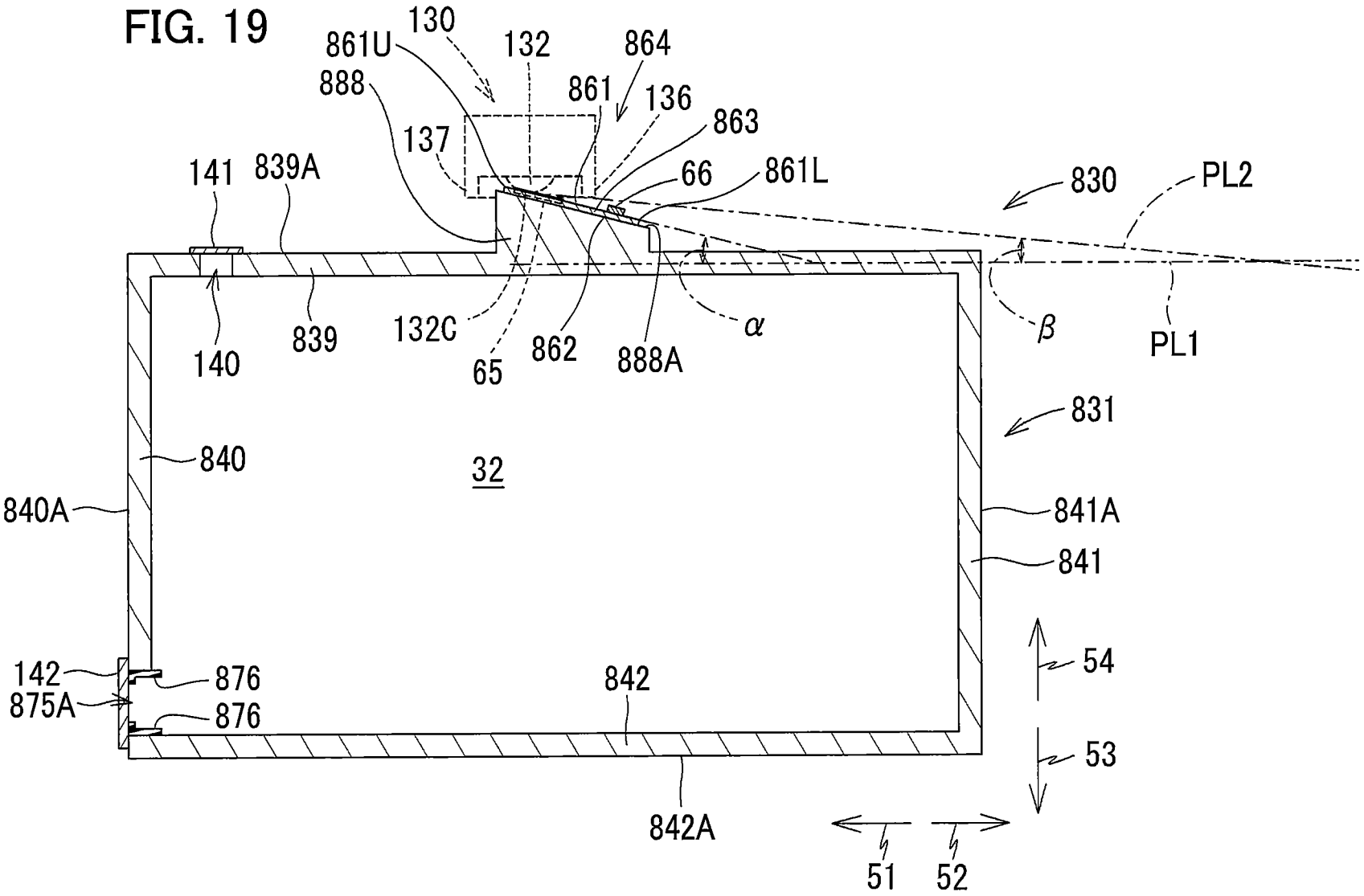
FIG. 19 is a vertical cross-sectional view of an ink cartridge according to a variation of the embodiment.

The structure of the ink cartridge 30 is not limited to those shown in FIGS. 4 to 6 and 12A through 18. For example, FIG. 19 depicts an ink cartridge 830 according to a sixth modification to the embodiment. The ink cartridge 830 includes a housing 831 and a circuit board 864. The housing 831 has a substantially rectangular parallelepiped shape. Specifically, in the housing 831, a rear wall 841 and a front wall 840 respectively extend vertically, while a bottom wall 842 and a top wall 839 extend horizontally. Hence, in the upright posture, a front surface 840A of the front wall 840 faces frontward, a rear surface 841A of the rear wall 841 faces rearward, a bottom surface 842A of the bottom wall 842 faces vertically downward, and a top surface 839A of the top wall 839 faces vertically upward.

In the structure of FIG. 19, the ink cartridge 830 does not include the projection 67, positioning surface 89, protruding part 43, operating part 90, cylinder 75, valve 79, and coil spring 80, unlike the ink cartridge 30 of the depicted embodiment. A sealing member 876 defining a passage 875A therein is fitted in a through-hole penetrating the front wall 840 in the front-rear direction. A front end of the passage 875A that is open on the front wall 840 is closed by a seal 142. A protruding part 888 is formed on the top surface 839A of the top wall 839 for supporting the circuit board 864 thereon. The protruding part 888 has a top surface 888A that is sloped relative to the virtual plane PL1, just as the top surface 88A of the protruding part 88 of the embodiment. The circuit board 864 includes a substrate 863 and the memory 66, but the battery 68 is dispensed with. The substrate 863 has a first surface 861 (top surface) and a second surface 862 opposite to the first surface 861. The second surface 862 of the substrate 863 is fixed to the sloped top surface 888A of the protruding part 888. Hence, the first surface 861 of the substrate 863 is sloped relative to the virtual plane PL1. Specifically, the first surface 861 slopes upward toward the front with the acute angle α formed between the first surface 861 and the virtual plane PL1. The electrodes 65 are formed on the first surface 861 at positions closer to an upper edge 861U of the first surface 861 than to a lower edge 861L of the first surface 861. The memory 66 is mounted on the first surface 861 at a position closer to the lower edge 861L than to the upper edge 861U. That is, the memory 66 is positioned lower than the electrodes 65 on the sloped first surface 861.

With the structure shown in FIG. 19, the ink cartridge 830 is inserted into the cartridge holder 101 of the cartridge-attachment portion 110, without being pivoted, in a direction diagonally upward and frontward. If the ink cartridge 830 is inserted in the front-rear direction without being pivoted, the rear wall 136 of the connector 130 needs to be omitted in order to prevent interference between the substrate 863 and the connector 130 during the insertion of the ink cartridge 830 into the cartridge-attachment section 110.

Other variations are further conceivable.

For example, in the circuit board 64 of the embodiment, the electrodes 65 are formed on the first surface 61 (upper surface) of the substrate 63. However, the electrodes 65 may be formed on the front end face 63A rather than the first surface 61.

Figure 20:
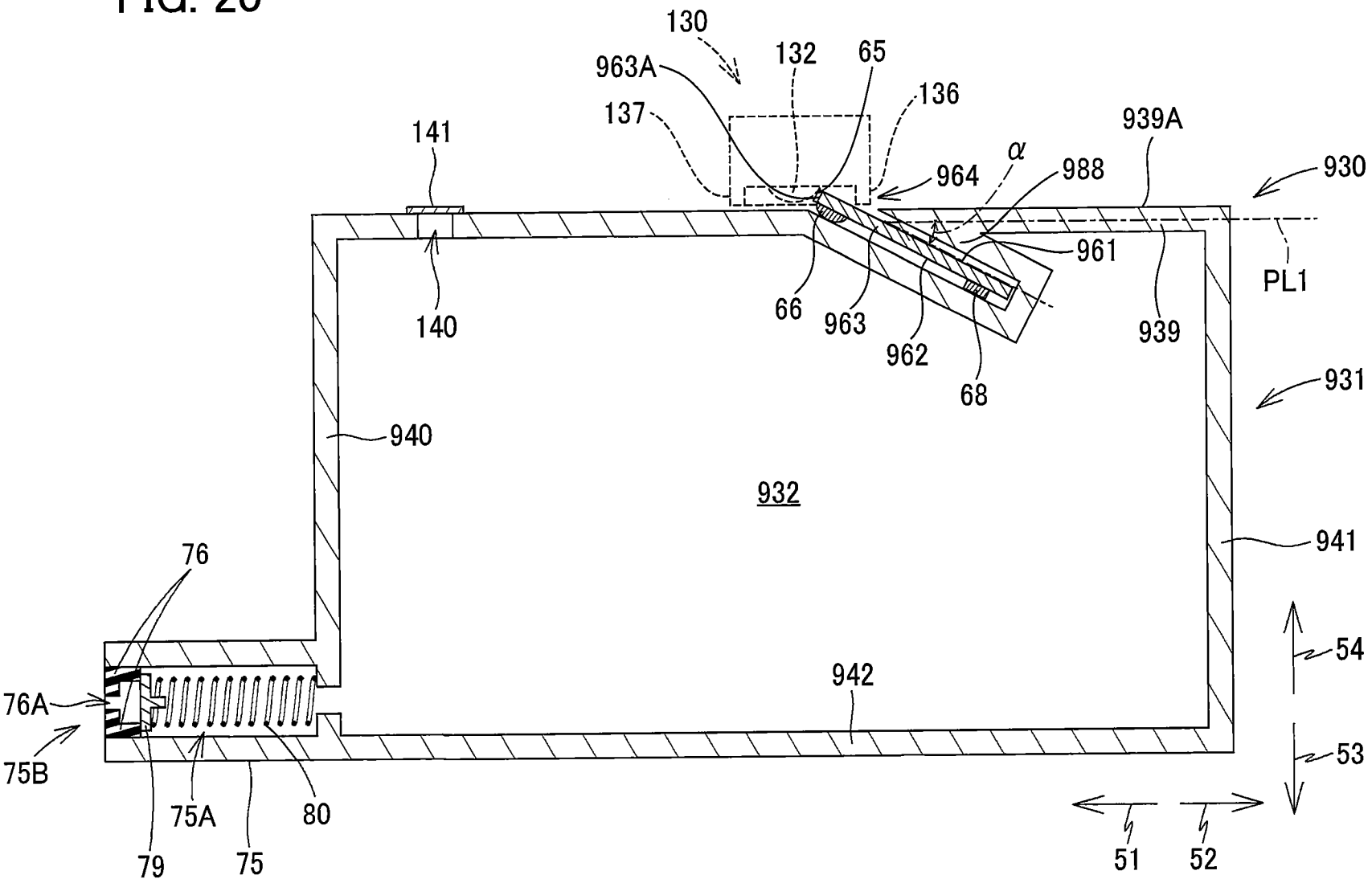
FIG. 20 is a vertical cross-sectional view of an ink cartridge according to still another variation of the embodiment.

As an example, FIG. 20 shows an ink cartridge 930 according to a variation of the embodiment. The ink cartridge 930 includes: a housing 931 defining a storage chamber 932 therein; and a circuit board 964 supported by a top wall 939 of the housing 931. The housing 931 of this variation has a generally rectangular shape in a vertical cross-sectional view, as in the sixth modification. Hence, in the upright posture, a rear wall 941 and a front wall 940 of the housing 931 respectively extend vertically, while a bottom wall 942 and a top wall 939 of the housing 931 extend horizontally. The passage 75A is formed in the cylinder 75 protruding frontward from the front wall 940.

The circuit board 964 includes a substrate 963 received in a support portion 988 that is recessed downward and frontward relative to a top surface 939A of the top wall 939. The electrodes 65 are formed on an upper end surface 963A of the substrate 963. In the upright posture, the upper end surface 963A defines a thickness of the substrate 963 in the front-rear direction between a first surface 961 and a second surface 962 of the substrate 963. As in the embodiment, the substrate 963 of this variation is arranged to be inclined relative to the virtual plane PL1 such that the first surface 961 is sloped relative to the virtual plane PL1 to form the angle α therebetween in the upright posture. The second surface 962 is also sloped relative to the virtual plane PL1 in this variation. The memory 66 and battery 68 are mounted on the second surface 962 of the substrate 963. The battery 68 is positioned lower than the memory 66. The memory 66 and battery 68 mounted on the second surface 962 of the substrate 963 are accommodated in the support portion 988 formed in the top wall 939.

In the attached state of the liquid cartridge 930, the electrodes 65 formed on the upper end surface 963A are positioned between the rear wall 136 and front wall 137 in the front-rear direction. In the attached state, the electrodes 65 are in contact with the contacts 132 of the connector 130 and the first surface 961 is separated from the rear wall 136, as in the embodiment.

With this structure of FIG. 20, the electrodes 65 can contact the contacts 132 of the connector 130 in the attached state of the ink cartridge 930 to the cartridge-attachment section 110, as in the embodiment, without interfering with the front wall 137 and rear wall 136 that are provided near the contacts 132 at the connector 130. Further, impact is less likely to be impinged on the battery 68, at least directly, since the battery 68 is accommodated in the support portion 988.

Still alternatively, the substrate may be arranged vertically, rather than inclined, relative to the virtual plane PL1. As an example, FIG. 21 depicts an ink cartridge 1030 in which a substrate 1063 is arranged vertically.

Specifically, the ink cartridge 1030 includes a housing 1031 defining a storage chamber 1032 therein, and a circuit board 1064 supported by a top wall 1039 of the housing 1031. The circuit board 1064 includes the substrate 1063 that extends vertically in the upright posture. In other words, each of a second surface 1062 and a first surface 1061 of the substrate 1063 forms an angle of 90 degrees relative to the virtual plane PL1. Hence, an upper end face 1063A of the substrate 1063 faces vertically upward, i.e., extends horizontally. In the upright posture, the substrate 1063 defines a length in the vertical direction that is greater than the thickness thereof in the front-rear direction. The electrodes 65 are formed on the upper end face 1063A of the substrate 1063. The memory 66 and battery 68 are mounted on the second surface 1062 of the substrate 1063. The substrate 1063 (circuit board 1064) is received in a support portion 1088 formed in the top wall 1039 of the housing 1031. The support portion 1088 is recessed vertically downward relative to a top surface 1039A of the top wall 1039.

In this variation, the electrodes 65 formed on the upper end face 1063A of the substrate 1063 faces vertically upward in the upright posture. The substrate 1063 supporting the electrodes 65 is positioned rearward of the front wall 137 and frontward of the rear wall 136 in the front-rear direction in the attached state of the ink cartridge 1030. That is, the electrodes 65 of the liquid cartridge 1030 in the attached state are positioned between the rear wall 136 and front wall 137 in the front-rear direction.

Figure 21:
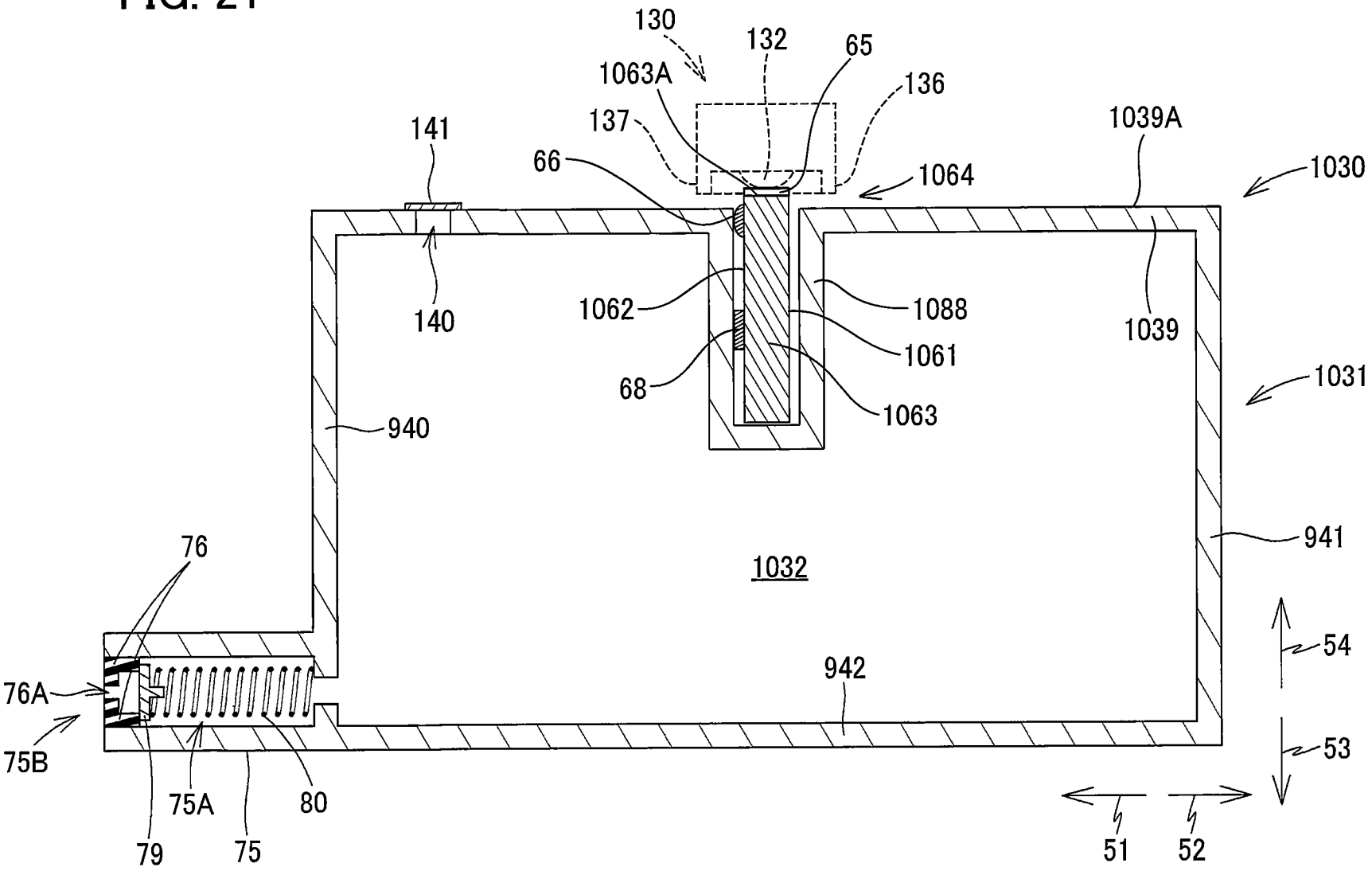
FIG. 21 is a vertical cross-sectional view of an ink cartridge according to a variation of the ink cartridge shown in FIG. 20.

With this structure of FIG. 21, the electrodes 65 can contact the contacts 132 of the connector 130 in the attached state of the ink cartridge 1030, without interfering with the front wall 137 and rear wall 136 that are provided near the contacts 132 at the connector 130. Further, impact is less likely to be impinged on the battery 68, at least directly, since the battery 68 is accommodated in the support portion 1088.

Further, the housing of the liquid cartridge of the present disclosure may not necessarily be configured as a single member, but may be configured of a plurality of members assembled to each other. Likewise, the top wall of the housing may not necessarily be configured of a single member but may be configured of a plurality of members assembled to each other. That is, the substrate of the present disclosure may be supported by an upper wall configured of more than one member.

Still further, in the depicted embodiment and various modifications thereto, the substrate is bonded to the top surface of the top wall of the housing, i.e., directly supported by the top wall of the housing. Alternatively, the substrate of the present disclosure may be supported indirectly by the top wall of the housing, through a separate member or even through a plurality of members.

In the depicted embodiment, ink is described as an example of liquid, but the liquid cartridge may store a liquid other than ink, such as a pretreatment liquid that is ejected onto sheets or the like prior to ink during a printing operation, or water for cleaning the recording head 21.

It should be apparent to those who skilled in the art that the embodiment, various modifications thereto and variations described above may be combined with one another as appropriate.

<Remarks>

The ink cartridges 30, 230, 330, 430, 530, 630, and 830 are an example of a liquid cartridge. The cartridge-attachment portion 110 is an example of an attachment portion. The printer 10 is an example of a printing device. The housings 31, 231, 331, 431, 531, 631 and 831 are an example of a housing. The storage chamber 32 is an example of a liquid chamber. The passages 75A and 875A are an example of a liquid passage. The substrates 63, 263, 363, 463, 563, 663 863 are an example of a substrate. The electrodes 65 are an example of a contact of the cartridge. The memory 66 is an example of a memory. The battery 68 is an example of an electronic component. The first surfaces 61, 261, 361, 461, 561, 661 and 861 are an example of a sloped surface. The virtual plane PL1 is an example of a first imaginary plane. The virtual plane PL2 is an example of a second imaginary plane. The virtual plane PL3 is an example of a third imaginary plane. The angle $\alpha$ is an example of a first acute angle. The angle $\beta$ is an example of a second acute angle. The angle $\gamma$ is an example of a third acute angle. The lock surface 151 is an example of an engagement surface. The cartridge holder 101 is an example of a holder. The contacts 132 are an example of a contact of the device. The front wall 137 is an example of a first wall. The rear wall 136 is an example of a second wall. The right wall 138 is an example of a third wall, and the left wall 139 is an example of a fourth wall.

What is claimed is:

1. A liquid cartridge configured to be inserted into an accommodating portion of a printing device in an insertion direction crossing a gravitational direction and attached to the accommodating portion in an upright posture, the liquid cartridge comprising:

a housing comprising:

a liquid chamber storing liquid therein; and a liquid passage extending forward in the insertion direction from the liquid chamber;

a substrate extending in the insertion direction, the substrate having an upper surface facing upward and sloping relative to the insertion direction in the upright posture, the substrate having a bottom surface opposite the upper surface;

a contact formed on the upper surface of the substrate;

a memory mounted on the upper surface of the substrate and electrically connected to the contact of the cartridge; and a battery mounted on the bottom surface of the substrate and electrically connected to the memory for supplying power to the memory, the battery being positioned lower than the contact of the cartridge in the upright posture, wherein, in the upright posture, an upper edge of the memory on the upper surface of the substrate is positioned lower than an upper edge of the contact of the cartridge on the upper surface of the substrate.

2. The liquid cartridge according to claim 1, wherein the upper surface has a front edge and a rear edge in the insertion direction in the upright posture, the upper surface sloping relative to the insertion direction such that the front edge is positioned higher relative to the rear edge in the upright posture.

3. The liquid cartridge according to claim 1, wherein the upper surface has a front edge and a rear edge in the insertion direction in the upright posture, the upper surface sloping relative to the insertion direction such that the front edge is positioned lower relative to the rear edge in the upright posture.

4. The liquid cartridge according to claim 1, wherein the upper surface defines a front edge and a rear edge in the insertion direction in the upright posture, and wherein the contact of the cartridge is formed on the upper surface at a position closer to the front edge than to the rear edge.

5. The liquid cartridge according to claim 1, wherein the substrate has an upper end face and a lower end face in the upright posture, wherein the battery is mounted on the bottom surface of the substrate at a position closer to the lower end face than to the upper end face in the upright posture.

6. The liquid cartridge according to claim 5, wherein the battery is positioned lower than the memory in the upright posture.

7. The liquid cartridge according to claim 1, wherein the substrate defines a length in the insertion direction and a width in a widthwise direction perpendicular to the insertion direction and the gravitational direction in the upright posture, the length being greater than the width.

8. The liquid cartridge according to claim 1, wherein the contact of the cartridge comprises a plurality of electrodes formed on the upper surface of the substrate, the plurality of electrodes extending in the insertion direction and being arranged to be aligned with one another in a widthwise direction perpendicular to the insertion direction and the gravitational direction in the upright posture.

9. The liquid cartridge according to claim 1, wherein the substrate is a rigid substrate.

10. The liquid cartridge according to claim 1, wherein the housing further comprises a support portion supporting the substrate thereon such that the upper surface slopes relative to the insertion direction.

11. The liquid cartridge according to claim 1, wherein the upper surface defines a front edge and a rear edge in the upright posture, and wherein the substrate has a thickness in the gravitational direction in the upright posture, the thickness being smaller near the rear edge than near the front edge.

* * * * *